US008047307B2

(12) United States Patent
Pessier et al.

(10) Patent No.: US 8,047,307 B2
(45) Date of Patent: Nov. 1, 2011

(54) HYBRID DRILL BIT WITH SECONDARY BACKUP CUTTERS POSITIONED WITH HIGH SIDE RAKE ANGLES

(75) Inventors: Rudolf Carl Pessier, Galveston, TX (US); Michael S. Damschen, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/340,299

(22) Filed: Dec. 19, 2008

(65) Prior Publication Data

US 2010/0155145 A1 Jun. 24, 2010

(51) Int. Cl.
*E21B 10/00* (2006.01)
*E21B 10/43* (2006.01)

(52) U.S. Cl. ..... 175/336; 175/431

(58) Field of Classification Search ..... 175/336, 175/350, 431

See application file for complete search history.

(56) References Cited

U.S. PATENT DOCUMENTS

| | | | |
|---|---|---|---|
| 228,780 | A | 6/1880 | Von Ringharz |
| 930,759 | A | 8/1909 | Hughes |
| 1,874,066 | A | 8/1932 | Scott et al. |
| 1,879,127 | A | 9/1932 | Schlumpf |
| 1,932,487 | A | 10/1933 | Scott |
| 2,030,722 | A | 2/1936 | Scott |
| 2,198,849 | A | 4/1940 | Waxler |
| 2,216,894 | A | 10/1940 | Stancliff |
| 2,297,157 | A | 9/1942 | McClinton |
| 2,719,026 | A | 9/1955 | Boice |
| 3,010,708 | A | 11/1961 | Hlinsky et al. |
| 3,055,443 | A | 9/1962 | Edwards |
| 3,174,564 | A | 3/1965 | Morlan |
| 3,269,469 | A | 8/1966 | Kelly, Jr. |
| 3,424,258 | A | 1/1969 | Nakayama |
| 3,825,080 | A | 7/1974 | Short |
| RE28,625 | E | 11/1975 | Cunningham |
| 4,006,788 | A | 2/1977 | Garner |
| 4,140,189 | A | 2/1979 | Garner |
| 4,190,126 | A | 2/1980 | Kabashima |

(Continued)

FOREIGN PATENT DOCUMENTS

| | | |
|---|---|---|
| EP | 0225101 | 6/1987 |

(Continued)

OTHER PUBLICATIONS

Buske et al. "Performance Paradigm Shift: Drilling Vertical and Directional Sections Through Abrasive Formations with Roller Cone Bits" Society of Petroleum Engineers—SPE 114975, CIPC/SPE Gas Technology Symposium 2008 Joint Conference, Canada, Jun. 16-19, 2008.

(Continued)

*Primary Examiner* — Daniel P Stephenson
(74) *Attorney, Agent, or Firm* — TraskBritt

(57) ABSTRACT

A hybrid drill bit may have a bit body, at least one blade extending longitudinally and radially outward from the face, at least one rolling cutter assembly mounted on the bit body, at least one primary cutter, and at least one cutter set including a first cutter and a second cutter. The cutter set may be positioned to substantially follow the at least one primary cutter along the cutting path upon rotation of the bit body. At least one cutter of the cutter set may have a high side rake angle.

41 Claims, 16 Drawing Sheets

U.S. PATENT DOCUMENTS

| | | | | |
|---|---|---|---|---|
| 4,270,812 | A | | 6/1981 | Thomas |
| 4,285,409 | A | | 8/1981 | Allen |
| 4,293,048 | A | | 10/1981 | Kloesel, Jr. |
| 4,320,808 | A | | 3/1982 | Garrett |
| 4,343,371 | A | | 8/1982 | Baker, III et al. |
| 4,359,112 | A | | 11/1982 | Garner et al. |
| 4,369,849 | A | | 1/1983 | Parrish |
| 4,410,284 | A | | 10/1983 | Herrick |
| 4,444,281 | A | | 4/1984 | Schumacher, Jr. et al. |
| 4,527,637 | A | | 7/1985 | Bodine |
| 4,572,306 | A | | 2/1986 | Dorosz |
| 4,657,091 | A | | 4/1987 | Higdon |
| 4,664,705 | A | | 5/1987 | Horton et al. |
| 4,690,228 | A | | 9/1987 | Voelz et al. |
| 4,726,718 | A | | 2/1988 | Meskin et al. |
| 4,727,942 | A | | 3/1988 | Galle et al. |
| 4,738,322 | A | | 4/1988 | Hall et al. |
| 4,765,205 | A | | 8/1988 | Higdon |
| 4,874,047 | A | | 10/1989 | Hixon |
| 4,875,532 | A | | 10/1989 | Langford, Jr. |
| 4,892,159 | A | | 1/1990 | Holster |
| 4,915,181 | A | | 4/1990 | Labrosse |
| 4,932,484 | A | | 6/1990 | Warren et al. |
| 4,936,398 | A | | 6/1990 | Auty et al. |
| 4,943,488 | A | | 7/1990 | Sung et al. |
| 4,953,641 | A | | 9/1990 | Pessier |
| 4,984,643 | A | | 1/1991 | Isbell et al. |
| 4,991,671 | A | | 2/1991 | Pearce et al. |
| 5,016,718 | A | | 5/1991 | Tandberg |
| 5,027,912 | A | | 7/1991 | Juergens |
| 5,028,177 | A | | 7/1991 | Meskin et al. |
| 5,030,276 | A | | 7/1991 | Sung et al. |
| 5,049,164 | A | | 9/1991 | Horton et al. |
| 5,116,568 | A | | 5/1992 | Sung et al. |
| 5,145,017 | A | | 9/1992 | Holster et al. |
| 5,176,212 | A | | 1/1993 | Tanberg |
| 5,224,560 | A | | 7/1993 | Fernandez |
| 5,238,074 | A | | 8/1993 | Tibbitts et al. |
| 5,287,936 | A | | 2/1994 | Grimes et al. |
| 5,289,889 | A | | 3/1994 | Gearhart et al. |
| 5,337,843 | A | | 8/1994 | Torgrimsen et al. |
| 5,346,026 | A | | 9/1994 | Pessier et al. |
| 5,429,200 | A | | 7/1995 | Blackman et al. |
| 5,439,068 | A | | 8/1995 | Huffstutler et al. |
| 5,452,771 | A | | 9/1995 | Blackman et al. |
| 5,467,836 | A | | 11/1995 | Grimes et al. |
| 5,513,715 | A | | 5/1996 | Dysart |
| 5,518,077 | A | | 5/1996 | Blackman et al. |
| 5,531,281 | A | * | 7/1996 | Murdock ..... 175/431 |
| 5,547,033 | A | | 8/1996 | Campos, Jr. |
| 5,553,681 | A | | 9/1996 | Huffstutler et al. |
| 5,558,170 | A | | 9/1996 | Thigpen et al. |
| 5,570,750 | A | | 11/1996 | Williams |
| 5,593,231 | A | | 1/1997 | Ippolito |
| 5,606,895 | A | | 3/1997 | Huffstutler |
| 5,624,002 | A | | 4/1997 | Huffstutler |
| 5,641,029 | A | | 6/1997 | Beaton et al. |
| 5,644,956 | A | | 7/1997 | Blackman et al. |
| 5,655,612 | A | | 8/1997 | Grimes et al. |
| D384,084 | S | | 9/1997 | Huffstutler et al. |
| 5,695,018 | A | | 12/1997 | Pessier et al. |
| 5,695,019 | A | | 12/1997 | Shamburger, Jr. |
| 5,755,297 | A | | 5/1998 | Young et al. |
| 5,862,871 | A | | 1/1999 | Curlett |
| 5,868,502 | A | | 2/1999 | Cariveau et al. |
| 5,873,422 | A | | 2/1999 | Hansen et al. |
| 5,941,322 | A | | 8/1999 | Stephenson et al. |
| 5,944,125 | A | | 8/1999 | Byrd |
| 5,967,246 | A | | 10/1999 | Caraway et al. |
| 5,979,576 | A | | 11/1999 | Hansen et al. |
| 5,988,303 | A | | 11/1999 | Arfele |
| 5,992,542 | A | | 11/1999 | Rives |
| 5,996,713 | A | | 12/1999 | Pessier et al. |
| 6,092,613 | A | | 7/2000 | Caraway et al. |
| 6,095,265 | A | | 8/2000 | Alsup |
| 6,109,375 | A | | 8/2000 | Tso |
| 6,173,797 | B1 | | 1/2001 | Dykstra et al. |
| 6,220,374 | B1 | | 4/2001 | Crawford |
| 6,241,036 | B1 | | 6/2001 | Lovato et al. |
| 6,260,635 | B1 | | 7/2001 | Crawford |
| 6,279,671 | B1 | | 8/2001 | Panigrahi et al. |
| 6,283,233 | B1 | | 9/2001 | Lamine et al. |
| 6,296,069 | B1 | | 10/2001 | Lamine et al. |
| RE37,450 | E | | 11/2001 | Deken et al. |
| 6,345,673 | B1 | | 2/2002 | Siracki |
| 6,360,831 | B1 | | 3/2002 | Akesson et al. |
| 6,386,302 | B1 | | 5/2002 | Beaton |
| 6,401,844 | B1 | | 6/2002 | Doster et al. |
| 6,405,811 | B1 | | 6/2002 | Borchardt |
| 6,408,958 | B1 | | 6/2002 | Isbell et al. |
| 6,415,687 | B2 | | 7/2002 | Saxman |
| 6,439,326 | B1 | | 8/2002 | Huang et al. |
| 6,446,739 | B1 | | 9/2002 | Richman et al. |
| 6,450,270 | B1 | | 9/2002 | Saxton |
| 6,474,424 | B1 | | 11/2002 | Saxman |
| 6,510,906 | B1 | | 1/2003 | Richert et al. |
| 6,510,909 | B2 | | 1/2003 | Portwood et al. |
| 6,527,066 | B1 | | 3/2003 | Rives |
| 6,533,051 | B1 | | 3/2003 | Singh et al. |
| 6,544,308 | B2 | | 4/2003 | Griffin et al. |
| 6,562,462 | B2 | | 5/2003 | Griffin et al. |
| 6,568,490 | B1 | | 5/2003 | Tso et al. |
| 6,585,064 | B2 | | 7/2003 | Griffin et al. |
| 6,589,640 | B2 | | 7/2003 | Griffin et al. |
| 6,592,985 | B2 | | 7/2003 | Griffin et al. |
| 6,601,661 | B2 | | 8/2003 | Baket et al. |
| 6,601,662 | B2 | | 8/2003 | Matthias et al. |
| 6,684,967 | B2 | | 2/2004 | Mensa-Wilmot et al. |
| 6,729,418 | B2 | | 5/2004 | Slaughter, Jr. et al. |
| 6,739,214 | B2 | | 5/2004 | Griffin et al. |
| 6,742,607 | B2 | | 6/2004 | Beaton |
| 6,749,033 | B2 | | 6/2004 | Griffin et al. |
| 6,797,326 | B2 | | 9/2004 | Griffin et al. |
| 6,843,333 | B2 | | 1/2005 | Richert et al. |
| 6,861,098 | B2 | | 3/2005 | Griffin et al. |
| 6,861,137 | B2 | | 3/2005 | Griffin et al. |
| 6,878,447 | B2 | | 4/2005 | Griffin et al. |
| 6,883,623 | B2 | | 4/2005 | McCormick et al. |
| 6,986,395 | B2 | | 1/2006 | Chen |
| 6,988,569 | B2 | | 1/2006 | Lockstedt et al. |
| 7,000,715 | B2 | | 2/2006 | Sinor et al. |
| 7,096,978 | B2 | | 8/2006 | Dykstra et al. |
| 7,111,694 | B2 | | 9/2006 | Beaton |
| 7,137,460 | B2 | | 11/2006 | Slaughter, Jr. et al. |
| 7,152,702 | B1 | | 12/2006 | Bhorne et al. |
| 7,234,550 | B2 | | 6/2007 | Azar et al. |
| 7,350,568 | B2 | | 4/2008 | Mandal et al. |
| 7,350,601 | B2 | | 4/2008 | Belnap et al. |
| 7,360,612 | B2 | | 4/2008 | Chen et al. |
| 7,377,341 | B2 | | 5/2008 | Middlemiss et al. |
| 7,387,177 | B2 | | 6/2008 | Zahradnik et al. |
| 7,392,862 | B2 | | 7/2008 | Zahradnik et al. |
| 7,398,837 | B2 | | 7/2008 | Hall et al. |
| 7,416,036 | B2 | | 8/2008 | Forstner et al. |
| 7,435,478 | B2 | | 10/2008 | Keshavan |
| 7,462,003 | B2 | | 12/2008 | Middlemiss |
| 7,473,287 | B2 | | 1/2009 | Belnap et al. |
| 7,493,973 | B2 | | 2/2009 | Keshavan et al. |
| 7,517,589 | B2 | | 4/2009 | Eyre |
| 7,533,740 | B2 | | 5/2009 | Zhang et al. |
| 7,568,534 | B2 | | 8/2009 | Griffin et al. |
| 7,841,426 | B2 | | 11/2010 | Zahradnik et al. |
| 7,845,435 | B2 | | 12/2010 | Zahradnik et al. |
| 2004/0173384 | A1 | | 9/2004 | Yong et al. |
| 2005/0087370 | A1 | | 4/2005 | Ledgerwood, III et al. |
| 2005/0178587 | A1 | | 8/2005 | Witman, IV et al. |
| 2005/0183892 | A1 | | 8/2005 | Oldham et al. |
| 2005/0263328 | A1 | | 12/2005 | Middlemiss |
| 2005/0273301 | A1 | | 12/2005 | Huang |
| 2006/0032674 | A1 | | 2/2006 | Chen et al. |
| 2006/0032677 | A1 | | 2/2006 | Azar et al. |
| 2006/0162968 | A1 | | 7/2006 | Durairajan et al. |
| 2006/0162969 | A1 | | 7/2006 | Belnap et al. |
| 2006/0196699 | A1 | | 9/2006 | Estes et al. |
| 2006/0254830 | A1 | | 11/2006 | Radtke |
| 2006/0266558 | A1 | | 11/2006 | Middlemiss et al. |
| 2006/0266559 | A1 | | 11/2006 | Keshavan et al. |

| | | | | |
|---|---|---|---|---|
| 2006/0278442 | A1 | 12/2006 | Kristensen | |
| 2006/0283640 | A1 | 12/2006 | Estes et al. | |
| 2007/0029114 | A1 | 2/2007 | Middle miss | |
| 2007/0062736 | A1 | 3/2007 | Cariveau et al. | |
| 2007/0079994 | A1 | 4/2007 | Middlemiss | |
| 2007/0187155 | A1 | 8/2007 | Middlemiss | |
| 2007/0227781 | A1 | 10/2007 | Cepeda et al. | |
| 2008/0066970 | A1 | 3/2008 | Zahradnik et al. | |
| 2008/0179108 | A1* | 7/2008 | McClain et al. | 175/431 |
| 2008/0264695 | A1 | 10/2008 | Zahradnik | |
| 2009/0159338 | A1 | 6/2009 | Buske | |
| 2009/0159341 | A1 | 6/2009 | Pessier et al. | |
| 2009/0166093 | A1 | 7/2009 | Pessier et al. | |
| 2009/0178855 | A1 | 7/2009 | Zhang et al. | |
| 2009/0183925 | A1 | 7/2009 | Zhang et al. | |
| 2010/0025119 | A1 | 2/2010 | Stauffer | |
| 2011/0005841 | A1* | 1/2011 | Wood et al. | 175/385 |

FOREIGN PATENT DOCUMENTS

| | | |
|---|---|---|
| EP | 0157278 | 11/1989 |
| EP | 0391683 | 1/1996 |
| EP | 2089187 | 8/2009 |
| GB | 2183694 | 6/1987 |
| WO | WO 85/02223 | 5/1985 |
| WO | WO 2008/124572 | 10/2008 |

OTHER PUBLICATIONS

Ersoy et al. "Wear Characteristics of PDC Pin and Hybrid Core Bits in Rock Drilling" Wear 188, Elsevier Science S. A., Mar. 1995, pp. 150-165.

George et al. "Significant Cost Savings Achieved Through the Use of PDC Nits in Compressed Air/Foam Applications" Society of Petroleum Engineers—SPE 116118, 2008 SPE Annual Technical Conference and Exhibition, Denver, Colorado Sep. 21-24, 2008.

Pessier et al. "Hybrid Bits Offer Distinct Advantages in Selected Roller Cone and PDC Bit Applications" IADC/SPE Drilling Conference and Exhibition, Feb. 2-4, 2010, New Orleans.

Sheppard et al. "Rock Drilling—Hybrid Bit Success for Syndax3 Pins" Industrial Diamon Review, Jun. 1993, pp. 309-311.

Tomlinson et al. "Rock Drilling—Syndax3 Pins-New Concepts in PCD Drilling" Industrial Diamond Review, Mar. 1992, pp. 109-114.

Warren et al. "PDC Bits: What's Needed to Meet Tomorrow's Challenge" SPE 27978, University of Tulsa Centennial Petroleum Engineering Symposium, Aug. 1994, pp. 207-214.

Wells et al. "Bit Balling Mitigation in PDC Bit Design" International Association of Drilling Contractors/Society of Petroleum Engineers—IADC/SPE 114673, IADC/SPE Asia Pacific Drilling Technology Conference and Exhibition, Indonesia, Aug. 25-27, 2008.

Williams et al. "An Analysis of the Performance of PDC Hybrid Drill Bits" SPE/IADC 16117, SPE/IADC Drilling Conference, Mar. 1987, pp. 585-594.

International Search Report for Intellectual Patent Application No. PCT/US2009/050672, Korean Intellectual Property Office, Mar. 3, 2010 (5 pages).

Written Opinion for International Patent Application No. PCT/US2009/050672, Korean Intellectual Property Office, Mar. 3, 2010 (5 pages).

International Search Report for International Patent Application No. PCT/US2009/042514, Korean Intellectual Property Office, Nov. 27, 2009 (2 pages).

International Search Report for International Patent Application No. PCT/US2008/083532, Feb. 2, 2009 (2 pages).

Smith Services, "Hole Opener—Model 6980 Hole Opener" retrieved from the Internet Jun. 11, 2010, using http://www.siismithservices.com/b_products/product_page.asp?ID=589.

Mills Machine Company, Inc. "Rotary Hole Openers—Section 8" retrieved from the Internet Jun. 11, 2010 using http://www.millsmachine.com/pages/home_page/mills_catalog/cat_holeopen/cat_holeopen.pdf.

International Search Report for Intellectual Patent Application No. PCT/US2009/067969, Korean Intellectual Property Office, May 25, 2010.

Written Opinion for International Patent Application No. PCT/US2009/067969, Korean Intellectual Property Office, May 25, 2010.

Written Opinion for International Patent Application No. PCT/US2009/042514, Korean Intellectual Property Office, Nov. 27, 2009.

Written Opinion for International Patent Application No. PCT/US2008/083532, Feb. 2, 2009.

International Report on Patentability for International Application No. PCT/US2008/083532, dated May 18, 2010.

International Report on Patentability for International Application No. PCT/US2009/042514, dated Nov. 2, 2010.

International Search Report for Intellectual Patent Application No. PCT/US2009/068399, Korean Intellectual Property Office, Aug. 4, 2010.

Written Opinion for International Application No. PCT/US2009/068399, Korean Intellectual Property Office, Aug. 4, 2010.

* cited by examiner

HYBRID DRILL BIT WITH SECONDARY BACKUP CUTTERS POSITIONED WITH HIGH SIDE RAKE ANGLES

CROSS-REFERENCE TO RELATED APPLICATIONS

This application is related to application Ser. No. 12/061,536, filed Apr. 2, 2008, now U.S. Pat. No. 7,845,435, issued Dec. 7, 2010, which is a Continuation-in-Part of application Ser. No. 11/784,025, filed Apr. 5, 2007 now U.S. Pat. No. 7,841,426 issued Nov. 30, 2010, and application Ser. No. 12/271,033, filed Nov. 14, 2008, both of which are incorporated herein in their entirety. This application is also related to application Ser. No. 12/578,278, filed Oct. 13, 2009.

TECHNICAL FIELD

The present invention relates in general to earth-boring bits and, in particular, to an improved bit having a combination of rolling cutters and fixed cutters and cutting elements and a method of design and operation of such bits.

BACKGROUND

The success of rotary drilling enabled the discovery of deep oil and gas reservoirs and production of enormous quantities of oil. The rotary rock bit was an important invention that made the success of rotary drilling possible. Only soft earthen formations could be penetrated commercially with the earlier drag bit and cable tool, but the two-cone rock bit, invented by Howard R. Hughes, U.S. Pat. No. 930,759, drilled the caprock at the Spindletop field near Beaumont, Tex., with relative ease. That venerable invention, within the first decade of the last century, could drill a scant fraction of the depth and speed of the modern rotary rock bit. The original Hughes bit drilled for hours; the modern bit now drills for days. Modern bits sometimes drill for thousands of feet instead of merely a few feet. Many advances have contributed to the impressive improvements in rotary rock bits.

In drilling boreholes in earthen formations using rolling cone or rolling cutter bits, rock bits having one, two, or three rolling cutters rotatably mounted thereon are employed. The bit is secured to the lower end of a drill string that is rotated from the surface or by downhole motors or turbines. The cutters mounted on the bit roll and slide upon the bottom of the borehole as the drill string is rotated, thereby engaging and disintegrating the formation material to be removed. The rolling cutters are provided with cutting elements or teeth that are forced to penetrate and gouge the bottom of the borehole by weight from the drill string. The cuttings from the bottom and sides of the borehole are washed away and disposed by drilling fluid that is pumped down from the surface through the hollow, rotating drill string, and the nozzles as orifices on the drill bit. Eventually the cuttings are carried in suspension in the drilling fluid to the surface up the annulus between the drill string and the borehole wall.

Rolling cutter bits dominated petroleum drilling for the greater part of the $20^{th}$ century. With improvements in synthetic or manmade diamond technology that occurred in the 1970s and 1980s, the fixed-cutter or "drag" bit became popular again in the latter part of the $20^{th}$ century. Modern fixed-cutter bits are often referred to as "diamond" or "PDC" (polycrystalline diamond compact) bits and are far removed from the original fixed-cutter bits of the $19^{th}$ and early $20^{th}$ centuries. Diamond or PDC bits carry cutting elements comprising polycrystalline diamond compact layers or "tables" formed on and bonded to a supporting substrate, conventionally of cemented tungsten carbide, the cutting elements being arranged in selected locations on blades or other structures on the bit body with the diamond tables facing generally in the direction of bit rotation. Diamond bits have an advantage over rolling cutter bits in that they generally have no moving parts. The drilling mechanics and dynamics of diamond bits are different from those of rolling cutter bits precisely because they have no moving parts. During drilling operation, diamond bits are used in a manner similar to that for rolling cutter bits, the diamond bits also being rotated against a formation being drilled under applied weight on bit to remove formation material. Engagement between the diamond cutting elements and the borehole bottom and sides shears or scrapes material from the formation, instead of using a crushing action as is employed by rolling cutter bits. Rolling cutter and diamond bits each have particular applications for which they are more suitable than the other; neither type of bit is likely to completely supplant the other in the foreseeable future.

In the prior art, some earth-boring bits use a combination of one or more rolling cutters and one or more fixed blades. Some of these combination-type drill bits are referred to as hybrid bits. Previous designs of hybrid bits, such as is described in U.S. Pat. No. 4,343,371, to Baker, III, have provided for the rolling cutters to do most of the formation cutting, especially in the center of the hole or bit. Other types of combination bits are known as "core bits," such as U.S. Pat. No. 4,006,788, to Garner. Core bits typically have truncated rolling cutters that do not extend to the center of the bit and are designed to remove a core sample of formation by drilling down, but around, a solid cylinder of the formation to be removed from the borehole generally intact.

Another type of hybrid bit is described in U.S. Pat. No. 5,695,019, to Shamburger, Jr., wherein the rolling cutters extend almost entirely to the center. Fixed-cutter inserts 50 (FIGS. 2 and 3) are located in the dome area 2 or "crotch" of the bit to complete the removal of the drilled formation. Still another type of hybrid bit is sometimes referred to as a "hole opener," an example of which is described in U.S. Pat. No. 6,527,066. A hole opener has a fixed-threaded protuberance that extends axially beyond the rolling cutters for the attachment of a pilot bit that can be a rolling cutter or fixed-cutter bit. In these latter two cases the center is cut with fixed-cutter elements but the fixed-cutter elements do not form a continuous, uninterrupted cutting profile from the center to the perimeter of the bit.

Although each of these bits is workable for certain limited applications, an improved hybrid earth-boring bit with enhanced drilling performance would be desirable.

SUMMARY OF THE INVENTION

A hybrid drill bit having secondary backup cutters positioned having high side rake angles.

DESCRIPTION OF THE INVENTION

Figure 1:
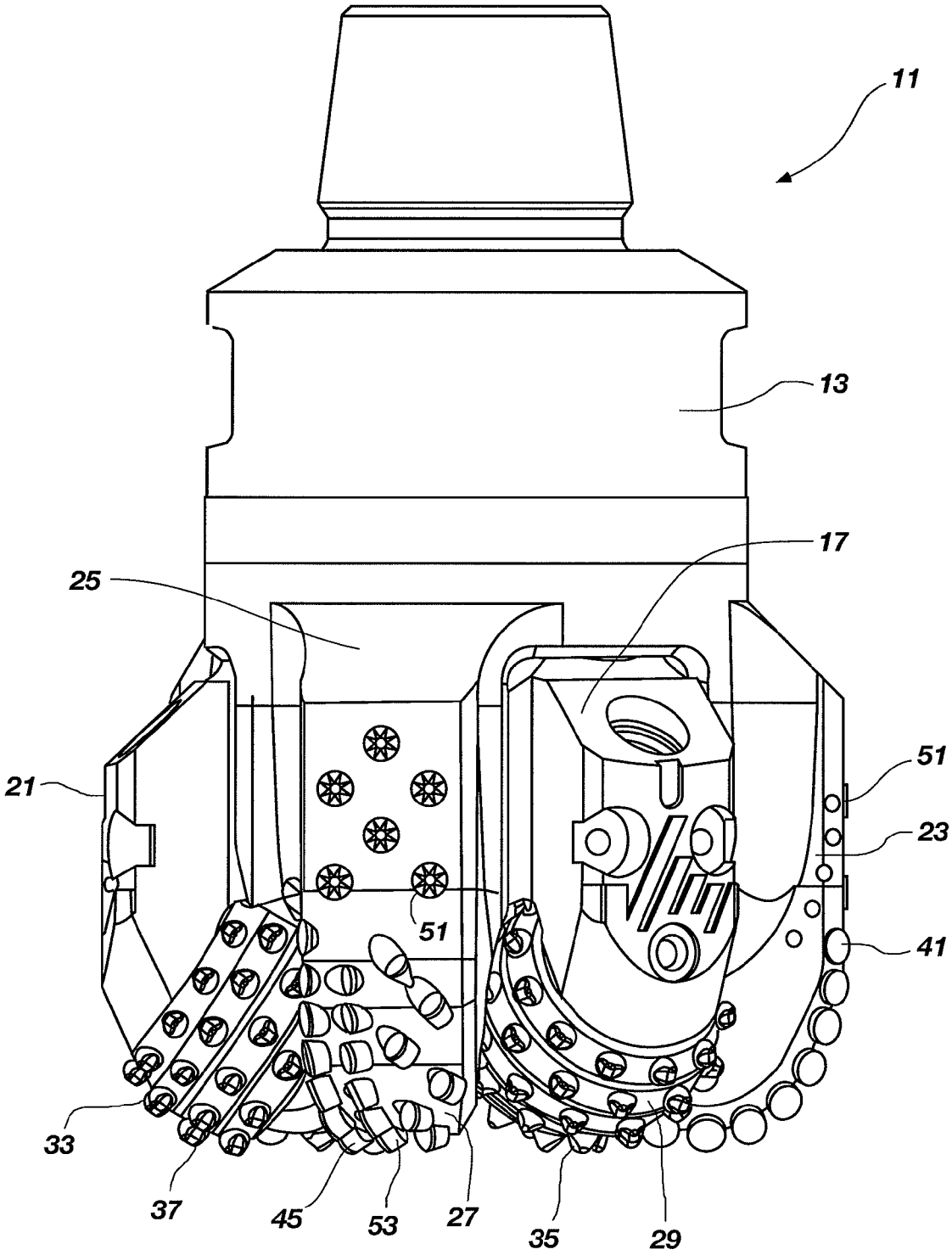
FIG. 1 is a view of a hybrid bit of the present invention.
Figure 2:
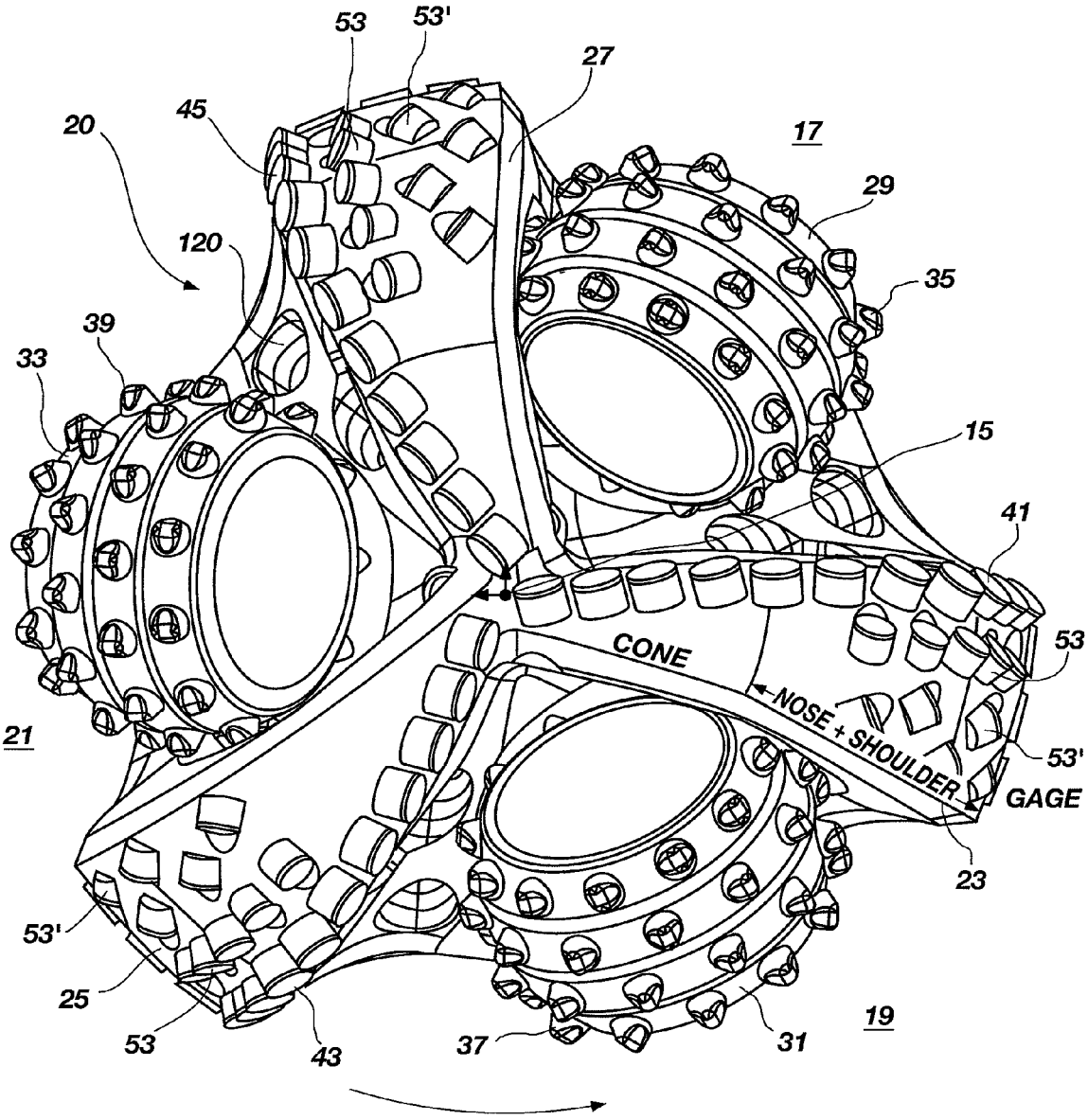
FIG. 2 is a face or plan view of and embodiment of the hybrid bit of FIG. 1.

Illustrated in FIGS. 1 and 2, is an embodiment of a hybrid earth-boring bit 11 according to the present invention. Hybrid bit 11 comprises a bit body 13 that is threaded or otherwise configured at its upper extent for connection into a drill string. Bit body 13 may be constructed of steel, or of a hard-metal (e.g., tungsten carbide) matrix material with steel inserts. Bit body 13 has an axial center or centerline 15 that coincides with the axis of rotation of hybrid bit 11 in most instances. The hybrid bit 11 of FIGS. 1 and 2 can use a "cutter-leading" configuration, that is a rolling cutter leading a fixed-blade cutter on the hybrid bit 11, "blade-leading" configuration, that is a fixed-blade cutter leading a rolling cutter on the hybrid bit 11, or "a cutter-opposite" configuration, that is a rolling cutter being located opposite a fixed-blade cutter hybrid bit. All such types of hybrid bits having fixed-blade cutters and rolling cutters as described herein wherein the hybrid bit has high side rake angled backup cutters on the fixed-blade cutters.

In FIG. 1, three bit legs 17, 19 (not shown), 21 depend axially downwardly from the bit body 13. A lubricant compensator is associated with each bit leg to compensate for pressure variations in the lubricant provided for the bearing in the bit leg. In between each bit leg 17, 19, 21, three fixed-blade cutters 23, 25, 27 depend axially downwardly from bit body 13.

A rolling cutter 29, 31, 33 is mounted for rotation (typically on a journal bearing, but rolling element or other bearings may be used as well) on each bit leg 17, 19, 21. Each rolling cutter 29, 31, 33 has a plurality of rolling cutter cutting elements 35, 37, 39 arranged in generally circumferential rows thereon. In the illustrated embodiment, rolling cutter cutting elements 35, 37, 39 are tungsten carbide inserts interference fit into bores or apertures formed in each rolling cutter 29, 31, 33. Alternatively, rolling cutter cutting elements 35, 37, 39 can be integrally formed with the cutter and hardfaced, as in steel- or milled-tooth cutters. Materials other than tungsten carbide, such as polycrystalline diamond or other super-hard or superabrasive materials, can also be used for rolling cutter cutting elements 35, 37, 39.

A plurality of fixed-blade cutting elements 41, 43, 45 are arranged in a row on the leading edge of each fixed-blade cutters 23, 25, 27, respectively. Each fixed-blade cutting element 41, 43, 45 is a circular disc of polycrystalline diamond mounted to a stud of tungsten carbide or other hard metal, which is in turn soldered, brazed or otherwise secured to the leading edge of each fixed-blade cutter. Thermally stable polycrystalline diamond (TSP) or other conventional fixed-blade cutting element materials may also be used. Each row of primary fixed-blade cutting elements 41, 43, 45 on each of the fixed-blade cutters 23, 25, 27 extends from the central portion of bit body 13 to the radially outermost or gage portion or surface of bit body 13. On at least one of the rows on one of the fixed-blade cutters 23, 25, 27, a fixed-blade cutting element is located at or near the centerline 15 of bit body 13 ("at or near" meaning some part of the fixed-blade cutting element is at or within about 0.040 inch of the centerline 15). In the illustrated embodiment, the radially innermost fixed-blade cutting element 41 in the row on fixed-blade cutter 23 has its circumference tangent to the axial center or centerline 15 of the bit body 13 and bit 11.

A plurality of flat-topped, wear-resistant inserts 51 formed of tungsten carbide or similar hard metal are provided on the radially outermost or gage surface or gage pad of each fixed-blade cutter 23, 25, 27. These serve to protect this portion of the bit from abrasive wear encountered at the sidewall of the borehole. Also, a row each of backup cutters 53, 53' are provided on each fixed-blade cutter 23, 25, 27 between the leading and trailing edges thereof. Backup cutters 53, 53' may be aligned with the primary fixed-blade cutting elements 41, 43, 45 on their respective fixed-blade cutters 23, 25, 27 so that they cut in the same swath or kerf or groove as the main fixed-blade cutting elements. Alternatively, they may be radially spaced apart from the primary fixed-blade cutting elements 41, 43, 45 so that they cut between the kerfs or grooves formed by the primary cutting elements on their respective fixed-blade cutters. Additionally, backup cutters 53, 53' provide additional points of contact or engagement between the hybrid bit 11 and the formation being drilled, thus enhancing the stability of hybrid bit 11.

FIG. 2 illustrates an embodiment of the earth-boring hybrid bit 11 having a "a cutter-opposite" configuration, that is a rolling cutter being located opposite a fixed-blade cutter of the hybrid bit 11 for the fixed-blade cutters 23, 25, 27 and rolling cutters 29, 31, 33 according to the present invention. Cutting elements 35, 37, 39 on each of the rolling cutters 29, 31, 33, respectively, are arranged to cut in the same swath or kerf or groove as the primary fixed-blade cutting elements 43, 45, 41 on the opposite or opposing fixed-blade cutters 25, 27, 23, respectively, of the hybrid bit 11. Thus, the cutting elements 35 on rolling cutter 29 fall in the same swath or kerf or groove or rotational path as the cutting elements 43 on the opposing fixed-blade cutter 25. The same is true for the cutting elements 37 on rolling cutter 31 and the cutting elements 45 on the opposing fixed-blade cutter 27; and the cutting elements 39 on rolling cutter 33 and the cutting elements 41 on opposing fixed-blade cutter 23. This is typically called a "cutter-opposite" configuration of cutting elements for the hybrid bit 11. In such an arrangement, rather than the cutting elements on a fixed-blade cutter or rolling cutter "leading" the cutting elements on a trailing rolling cutter or fixed-blade cutter, the cutting elements on a fixed-blade cutter or rolling cutter "oppose" those on the opposing or opposite rolling cutter or fixed-blade cutter.

In the embodiment in FIG. 2, rolling cutters 29, 31, 33 are angularly spaced approximately 120 degrees apart from each other (measured between their axes of rotation). The axis of rotation of each rolling cutter 29, 31, 33 intersecting the axial center 15 of bit body 13 or hybrid bit 11, although each or all of the rolling cutters 29, 31, 33 may be angularly skewed by any desired amount and (or) laterally offset so that their individual axes do not intersect the axial center of bit body 13 or hybrid bit 11.

Fluid courses 20 lie between blades 29, 31, 33 and are provided with drilling fluid by ports 120 being at the end of passages leading from a plenum extending into a bit body from a tubular shank (See FIG. 1) at the upper end of the hybrid bit 11. The ports 120 may include any desired nozzles secured thereto for enhancing and controlling flow of the drilling fluid. Fluid courses 20 extend to junk slots extending upwardly along the longitudinal side of hybrid bit 11 between fixed-blade cutters 23, 25, 27. Gage pads (See FIG. 1) comprise longitudinally upward extensions of fixed-blade cutters 23, 25, 27 and may have wear-resistant inserts or coatings on radial outer surfaces thereof as known in the art. Formation cuttings are swept away from the cutting elements 41, 43, 45 by drilling fluid (not shown) emanating from ports 120 and which moves generally radially outwardly through fluid courses 20 and then upwardly through junk slots to an annulus between drill string and borehole wall. The drilling fluid provides cooling to the primary cutting elements 41, 43, 45 on the fixed-blade cutters 23, 25, 27 during drilling and clears formation cuttings from the face of the hybrid bit 11.

Each of the cutting elements 41, 43, 45 in this embodiment is a PDC cutter. However, it is recognized that any other suitable type of cutting element may be utilized with the embodiments of the invention presented. For clarity, the cutters are shown as unitary structures in order to better describe and present the invention. However, it is recognized that the cutting elements 41, 43, 45 may comprise layers of materials. In this regard, the cutting elements 41, 43, 45 (e.g., PDC cutters) of the current embodiment each comprise a diamond table bonded to a supporting substrate, as previously described. The cutting elements 41, 43, 45 remove material from the underlying subterranean formations by a shearing action as the hybrid drill bit 11 is rotated by contacting the formation with cutting edges of the cutting elements 41, 43, 45. As the formation is cut, the flow of drilling fluid dispenses the formation cuttings and suspends and carries the particulate mix away through the junk slots.

The fixed-blade cutters 23, 25, 27 are each considered to be primary blades. The fixed-blade cutter 23, as with fixed-blade cutters 25, 27, in general terms of a primary blade, includes a cone portion and a nose and shoulder portion that extends (longitudinally and radially projects) from the face to the gage of hybrid bit 11. As illustrated, some of the backup cutters 53, 53', more specifically backup cutters 53', of the hybrid bit 11 are set at high side rake angles in the range of approximately 10° to 60° or, in the alternative, approximately 5° to 75°, as discussed herein and illustrated in FIGS. 2A through 2D, and FIGS. 4 through 4G to keep debris and cuttings from accumulating in front of the backup cutters 53, 53', which renders them ineffective. The side rake angle of the backup cutters 53, 53' depends upon the desired amount of debris deflection and desired path of the debris towards the open spaces between the aft of the fixed blade and the front of the rolling cutters, the size of the hybrid drill bit 11, the fluid hydraulic design of the hybrid bit, number of cutting elements, such as 41, 53, 53' on fixed-blade cutter 23 on the hybrid bit 11, and the total number of fixed blade and rolling cutters.

One or more additional backup cutter rows of backup cutters 53, 53' may be included on a fixed-blade cutter 23, 25, 27 of a hybrid bit 11 rotationally following and in further addition to primary cutting elements 41, 43, 45, of each fixed-blade cutter 23, 25, 27 and backup cutters 53, 53'. Each of the one or more additional backup cutter rows, the backup cutter row and the primary cutter row include one or more cutting elements on the same blade. Each of the cutting elements of the one or more additional backup cutter rows may align or substantially align in a concentrically rotational swath or kerf or rotational path with the cutting elements of the row that rotationally leads it. Optionally, each cutting element may radially follow slightly off-center from the rotational swath or kerf or rotational path of the cutting elements located in the backup cutter row and the primary cutting elements 41, 43, 45 of each fixed-blade cutter 23, 25, 27.

Each additional backup cutter may have a specific exposure with respect to a preceding backup cutter on a fixed-blade cutter 23, 25, 27 of a hybrid bit 11. For example, each backup cutter 53, 53' may have the same exposure or incrementally step-down in values of exposure from a preceding backup cutter 53, 53', in this respect each backup cutter 53, 53' is progressively underexposed with respect to a prior backup cutter. Optionally, each subsequent backup cutter 53, 53' may have an underexposure to a greater or lesser extent from the backup cutter 53, 53' preceding it. By adjusting the amount of underexposure for the backup cutters 53, 53', the backup cutters may be engineered to come into contact with the material of the formation as the wear-flat area progressively increases from the primary cutters to the following backup cutters. In this respect, the backup cutters may be designed to prolong the life of the hybrid bit 11. Generally, a primary cutting element, such as 41, 43, 45 is located typically on the front of a fixed-blade cutter 23, 27, 25 to provide the majority of the cutting work load, particularly when the cutters are less worn. As the primary cutting elements 41, 43, 45 of the hybrid bit 11 are subjected to harmful dynamics or as the cutting elements wear, the backup cutters 53, 53' begin to engage the formation and begin to take on or share the work from the primary cutters in order to better remove the material of the formation.

Figure 2A:
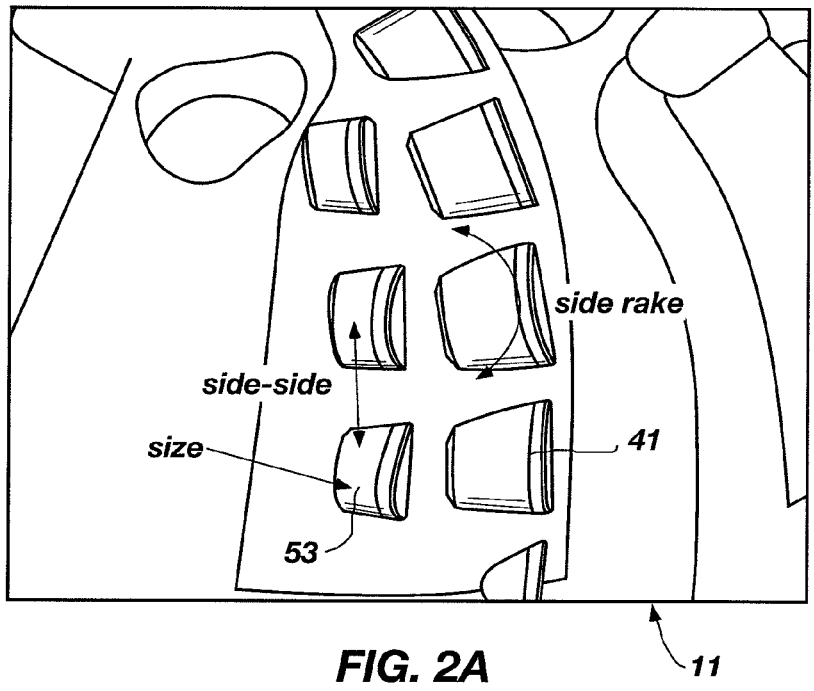
FIG. 2A is a view of a primary cutter and a backup cutter of the hybrid bit of the present invention.

Illustrated in FIG. 2A is a partial view of a rotary drag bit 11 showing the concept of cutter side rake (side rake) regarding cutting elements 41, cutter placement (side-side) regarding backup cutters 53, and cutter size (size). "Side rake" is described above. "Side-side" is the amount of distance between cutters in adjacent cutter rows. "Size" is the cutter size, typically indicated by the cutter's diameter.

Figure 2B:
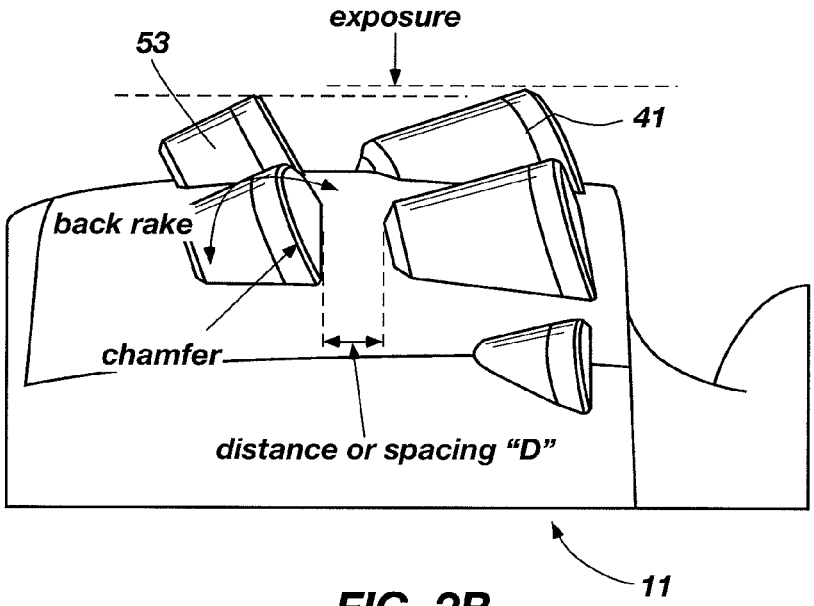
FIG. 2B is a view of a primary cutter and a backup cutter of the hybrid bit of the present invention.

FIG. 2B illustrates a partial side view of the hybrid bit 11 of FIG. 2 showing the concepts of back rake regarding backup cutters 53, exposure and chamfer regarding cutting elements 41 and spacing regarding cutting elements 41 and backup cutters 53.

Figure 2C:
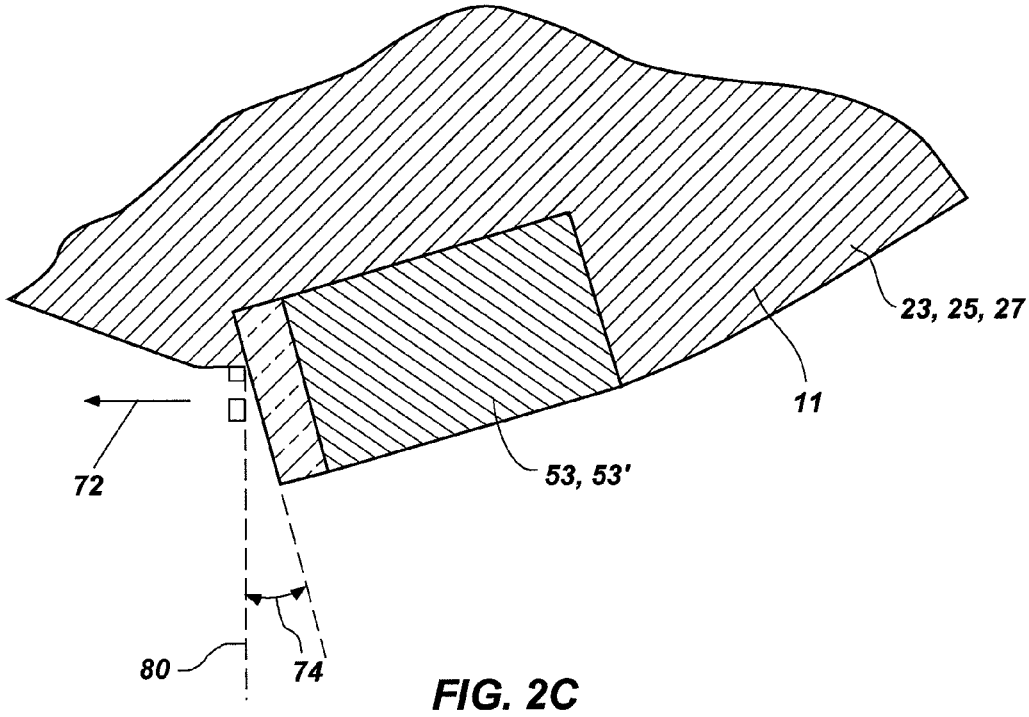
FIG. 2C is a view of a backup cutter on a blade of the hybrid bit of the present invention.

FIG. 2C is a cross sectional view through the center of a backup cutter 53, 53' positioned on a fixed-blade cutter 23, 25, 27 of the hybrid bit 11 (FIG. 1). The cutting direction is represented by the directional arrow 72. The backup cutter 53, 53' may be mounted on the fixed-blade cutters 23, 25, 27 in an orientation such that the cutting face of the backup cutter 53, 53' is oriented at a back rake angle 74 with respect to a line 80. The line 80 may be defined as a line that extends radially outward from the face of the drill bit 11 in a direction substantially perpendicular thereto at that location. Additionally or alternatively, the line 80 may be defined as a line that extends radially outward from the face of the drill bit 11 in a direction substantially perpendicular to the cutting direction 72. The back rake angle 74 may be measured relative to the line 80, positive angles being measured in the counter-clockwise direction, negative angles being measured in the clockwise direction.

The backup cutter 53, 53' is shown in FIG. 2C having a positive back rake angle of approximately 20°, thus exhibiting a "back rake." In other implementations, the backup cutter 53, 53' may have a negative back rake angle. In such a configuration, the backup cutter 53, 53' may be said to have a "forward rake." By way of example and not limitation, each backup cutter 53, 53' on the face of the drill bit 11 shown in FIG. 1 may, conventionally, have a back rake angle in a range extending from about 5° to about 30°.

Figure 2D:
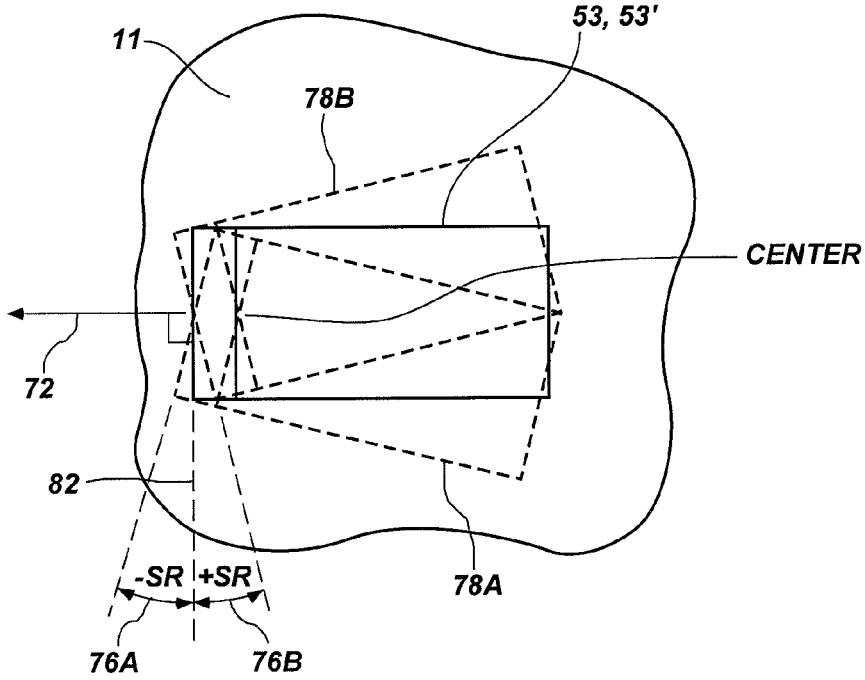
FIG. 2D is a view illustrating side rake of a backup cutter on a blade of the hybrid bit of the present invention.

FIG. 2D is an enlarged partial side view of a backup cutter 53, 53' mounted on a fixed-blade cutter 23, 25, 27 at the face of the drill bit 11 shown in FIG. 1. The cutting direction is represented by the directional arrow 72. The backup cutter 53, 53' may be mounted on the fixed-blade cutter 23, 25, 27 in an orientation such that the cutting face of the backup cutter 53, 53' is oriented substantially perpendicular to the cutting direction 72. In such a configuration, the backup cutter 53, 53' does not exhibit a side rake angle. The side rake angle of the backup cutter 53, 53' may be defined as the angle between a line 82, which is oriented substantially perpendicular to the cutting direction 72, and the cutting face of the backup cutter 53, 53', positive angles being measured in the counter-clockwise direction, negative angles being measured in the clockwise direction. In additional embodiments, the backup cutter 53, 53' may be mounted in the orientation represented by the dashed line 78A. In this configuration, the backup cutter 53, 53' may have a negative side rake angle 76A. Furthermore, the backup cutter 53, 53' may be mounted in the orientation represented by the dashed line 78B. In this configuration, the backup cutter 53, 53' may have a positive side rake angle 76B. By way of example and not limitation, each backup cutter 53, 53' on the face of the drill bit 11 shown in FIG. 1 may have a side rake angle in a range extending from approximately 10° to 60° or, in the alternative, approximately 5° to 75°, although if desired, they may have a negative side rake angle of approximately the same range or greater.

Figure 3:
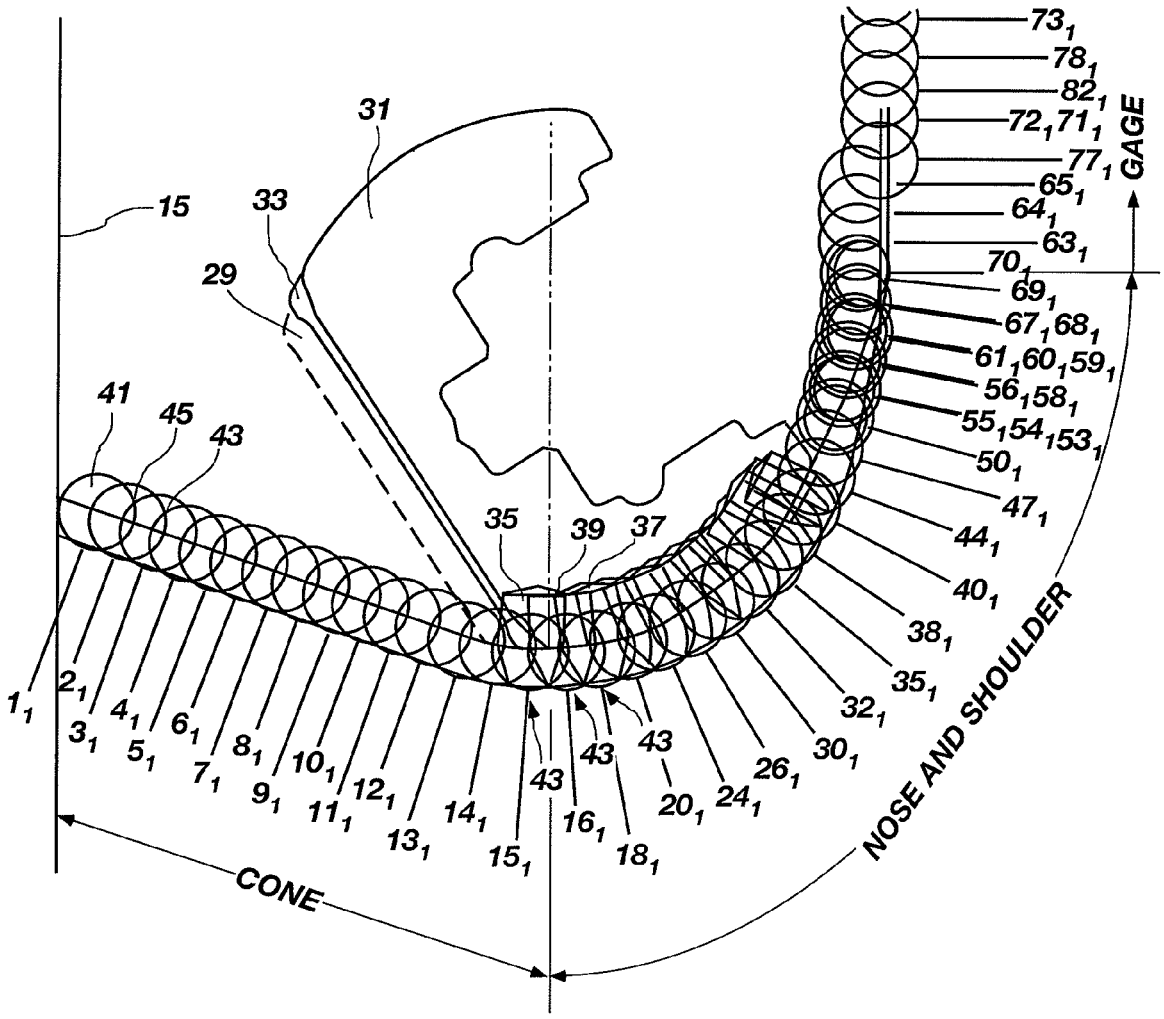
FIG. 3 illustrates a representation of the cutter layout of the hybrid bit of the present invention.

In FIG. 3, a cutting profile for the fixed-blade cutting elements 41, 43, 45 on fixed-blade cutters 23, 25, 27 and cutting elements 35, 37, 39 on rolling cutters 29, 33, 31 are generally illustrated. As illustrated, an innermost cutting element 41 on fixed-blade cutter 23 is tangent to the axial center 15 of the bit body 13 or hybrid bit 11. The next innermost cutting element 45 on fixed-blade cutter 27 is illustrated. Also, the third innermost cutting element 43 on fixed-blade cutter 25 is also illustrated. A cutting element 39 on rolling cutter 33 is illustrated having the same cutting depth or exposure and cutting element 41 on fixed-blade cutter 23 each being located at the same centerline and cutting the same swath or kerf or groove or rotational path. As illustrated, some cutting elements 41 on fixed-blade cutter 23 are located in the cone of the hybrid bit 11, while other cutting elements 41 are located in the nose, shoulder, and gage portion of the hybrid bit 11. Cutting elements 39 of rolling cutter 33 cut the same swath or kerf or groove or rotational path as cutting elements 41 in the nose and shoulder of the hybrid bit 11. Cutting elements 35, 37, 39 on rolling cutters 29, 31, 33 do not extend into the cone of the hybrid bit 11 but are generally located in the nose and shoulder of the hybrid bit 11 out to the gage of the hybrid bit 11. Further illustrated in FIG. 3 are the cutting elements 35, 37 on rolling cutters 29 and 31 and their relation to the cutting elements 43 and 45 on fixed-blade cutters 25, 27 cutting the same swath or kerf or groove or rotational path either being centered thereon or offset in the same swath or kerf or groove or rotational path during a revolution of the hybrid drill bit 11. Each cutting element 41, 43, 45 and cutting element 35, 37, 39 has been illustrated having the either the same exposure of depth of cut or different exposure of depth of cut so that each cutting element cuts either the same amount of formation or a different amount of formation at different areas of cutting elements on the hybrid bit 11. The depth of cut for each cutting element may be varied in the same swath or kerf or groove or rotational path as desired.

Figure 3A:
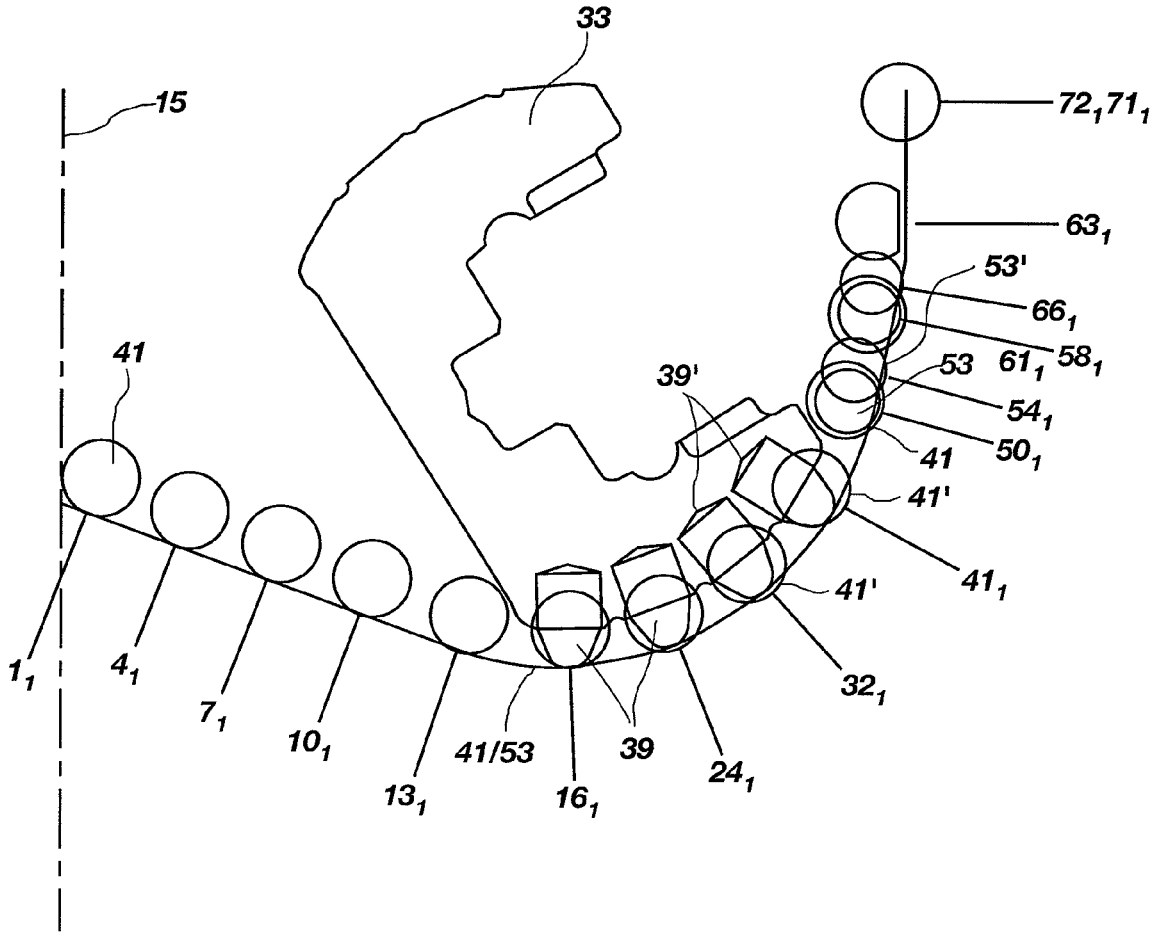
FIGS. 3A through 3C are cutter layouts for a blade and a rolling cutter of the hybrid bit of the present invention.

Illustrated in FIG. 3A is a cutting profile for the fixed-blade cutting elements 41 on fixed-blade cutter 23 and cutting elements 39 on rolling cutter 33 in relation to the each other. The fixed-blade cutter 23 and the rolling cutter 33 are a pair of cutters on hybrid bit 11 as an opposed blade and rolling cutter pair. As illustrated, some of the cutting elements 41 on fixed-blade cutter 23 and cutting element 39 on rolling cutter 33 both have the same center and cut in the same swath or kerf or groove while other cutting elements 41' on fixed-blade cutter 23 and cutting element 39' on rolling cutter 33 do not have the same center but still cut in the same swath or kerf or groove or rotational path. As illustrated, all the cutting elements 41 and 41' on fixed-blade cutter 23 and cutting elements 39 and 39' on rolling cutter 33 have the same exposure or different exposure to cut either the same depth or different depth of formation during a revolution of the hybrid drill bit 11, although this may be varied as desired. Further illustrated in FIG. 3A are backup cutters 53, 53' (e.g., cutting elements) on fixed-blade cutter 23 located behind cutting elements 41. Backup cutters 53, 53' may have the same exposure, or less exposure, or, if desired, more exposure than primary cutting elements 41 and have the same diameter or a smaller diameter than cutting element 41. Additionally, backup cutters 53, 53' while cutting in the same swath or kerf or groove or rotational path as a cutting element 41 may be located off the center of a cutting element 41 located in front of a backup cutter 53, 53' associated therewith. In this manner, cutting elements 41 and backup cutters 53, 53' on fixed-blade cutter 23 and cutting elements 39 on rolling cutter 33 will all cut in the same swath or kerf or groove or rotational path while being either centered on each other of slightly off-centered from each other having the same exposure of cut or, in the alternative, a lesser exposure of cut.

Figure 3B:
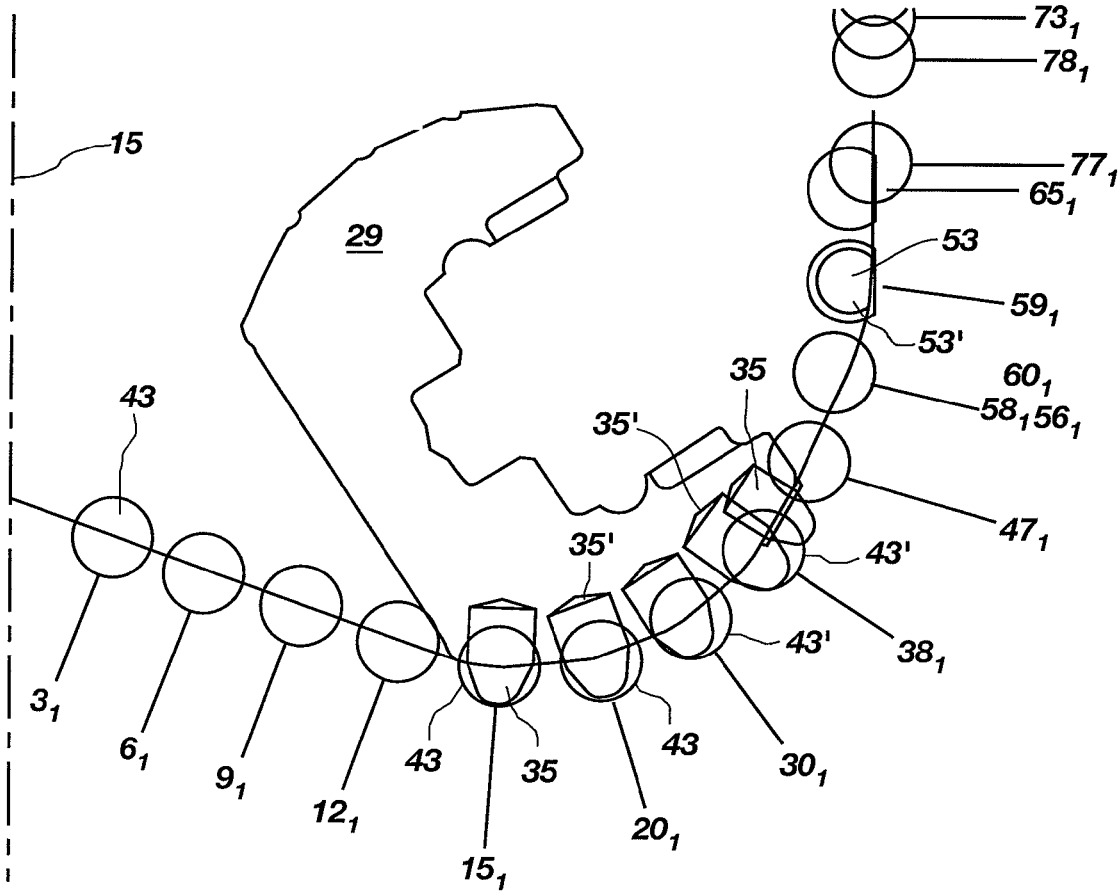

Illustrated in FIG. 3B is a cutting profile for the fixed-blade cutting elements 43 on fixed-blade cutter 25 and cutting elements 35 on rolling cutter 29 in relation to the each other. The fixed-blade cutter 25 and the rolling cutter 29 are a pair of cutters on hybrid bit 11 as an opposed blade and rolling cutter pair. As illustrated, some of the cutting elements 43 on fixed-blade cutter 25 and cutting element 35 on rolling cutter 29 both have the same center and cut in the same swath or kerf or groove or rotational path while other cutting elements 43' on fixed-blade cutter 25 and cutting element 35' on rolling cutter 29 do not have the same center but still cut in the same swath or kerf or groove or rotational path. As illustrated, all the cutting elements 43 and 43' on fixed-blade cutter 25 and cutting elements 35 and 35' on rolling cutter 29 have the same exposure or less exposure or a different exposure to cut either the same depth or different depth of formation during a revolution of the hybrid drill bit 11, although this may be varied as desired. Further illustrated in FIG. 3B are backup cutters 53, 53' on fixed-blade cutter 25 located behind cutting elements 43 may have the same exposure, or less exposure, or, if desired, more exposure as that of cut as cutting elements 43 and have the same diameter or a smaller diameter than a cutting element 43. Additionally, backup cutters 53, 53' while cutting in the same swath or kerf or groove or rotational path as a cutting element 43' may be located off the center of a cutting element 43 located in front of a backup cutters 53, 53' associated therewith. In this manner, cutting elements 43 and backup cutters 53, 53' on fixed-blade cutter 25 and cutting elements 35 on rolling cutter 29 will all cut in the same swath or kerf or groove or rotational path while being either centered on each other of slightly off-centered from each other having the same exposure of cut or, in the alternative, a lesser exposure.

Figure 3C:
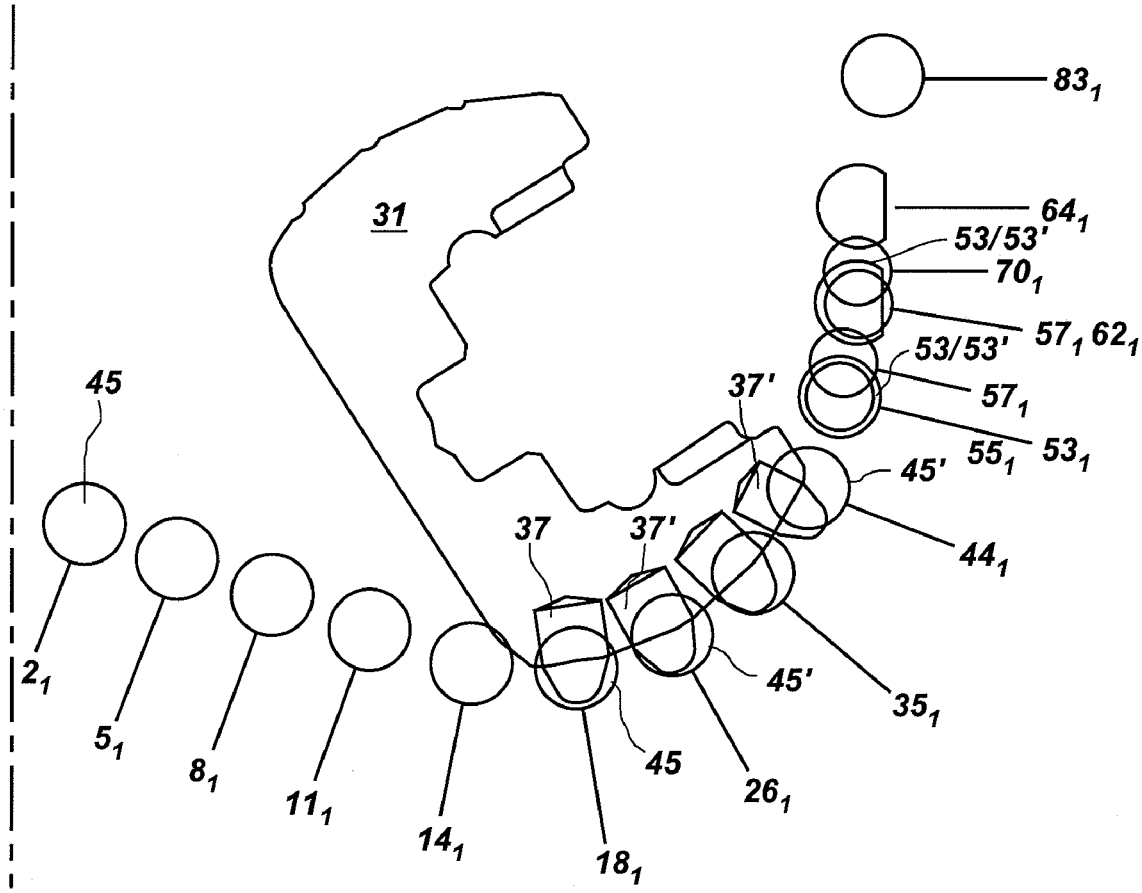

Illustrated in FIG. 3C is a cutting profile for the fixed-blade cutting elements 45 on fixed-blade cutter 27 and cutting elements 37 on rolling cutter 31 in relation to the each other, the fixed-blade cutter 27 and the rolling cutter 31 are a pair of cutters on hybrid bit 11 as an opposed blade and rolling cutter pair. As illustrated, some of the cutting elements 45 on fixed-blade cutter 27 and cutting element 37 on rolling cutter 31 both have the same center and cut in the same swath or kerf or groove or rotational path while other cutting elements 45' on fixed-blade cutter 27 and cutting element 37' on rolling cutter 31 do not have the same center but still cut in the same swath or kerf or groove. As illustrated, all the cutting elements 45 and 45' on fixed-blade cutter 27 and cutting elements 37 and 37' on rolling cutter 31 have the same exposure or different exposure to cut either the same depth or different depth of formation during a revolution of the hybrid drill bit 11, although this may be varied as desired. Further illustrated in FIG. 3C are backup cutters 53, 53' on fixed-blade cutter 27 located behind cutting elements 45 may have the same exposure, or less exposure, or, if desired, more expose as that of cut as cutting elements 45 and have the same diameter or a smaller diameter than a cutting element 45. Additionally, backup cutters 53, 53' while cutting in the same swath or kerf or groove or rotational path as a cutting element 45 may be located off the center of a cutting element 45 located in front of a backup cutters 53, 53' associated therewith. In this manner, cutting elements 45 and backup cutters 53, 53' on fixed-blade cutter 27 and cutting elements 37 on rolling cutter 31 will all cut in the same swath or kerf or groove or rotational path while being either centered on each other of slightly off-centered from each other having the same exposure of cut or, in the alternative, a lesser exposure of cut.

Figure 4:
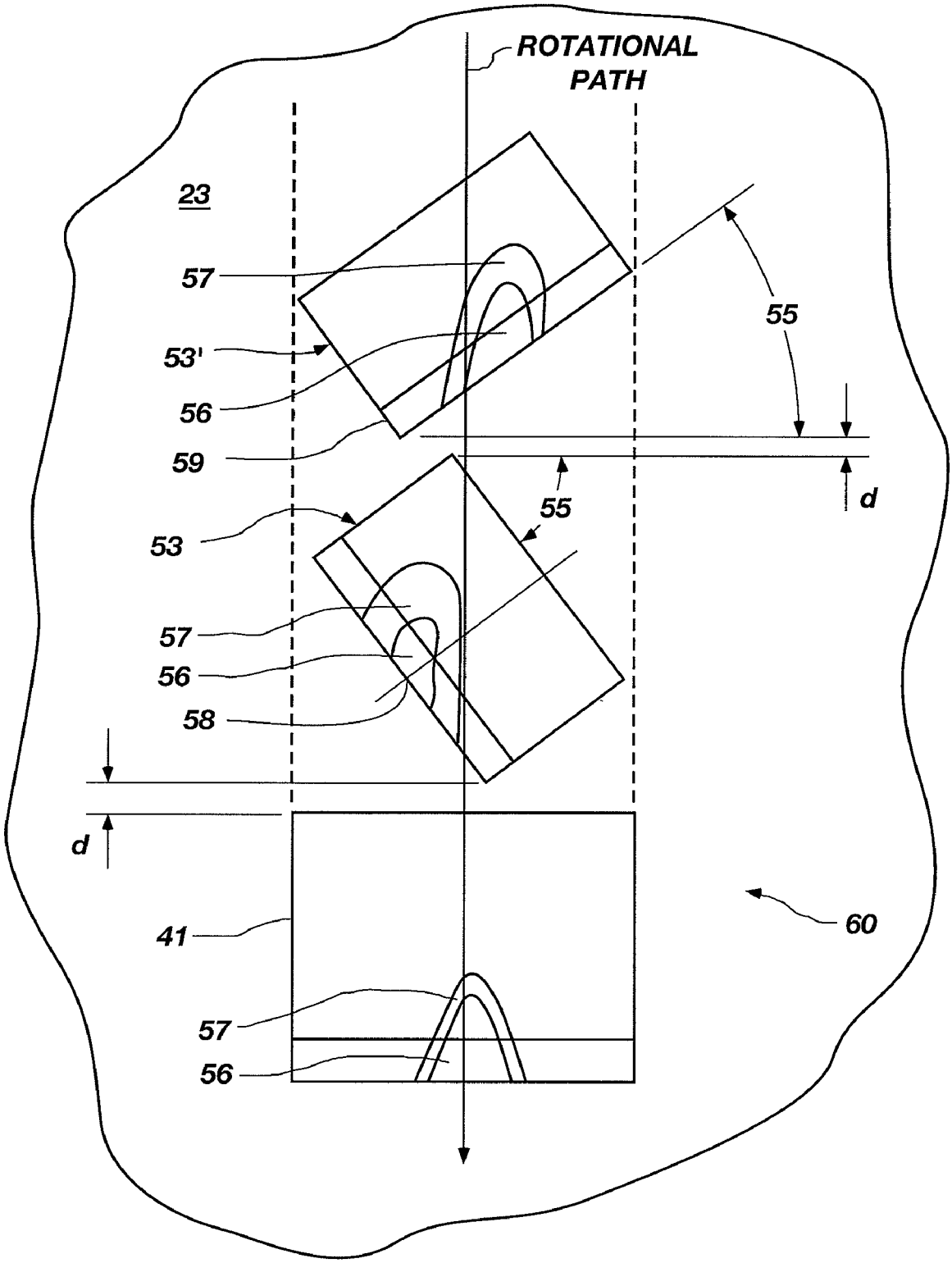
FIGS. 4 through 4G are top views of inline cutter sets of the hybrid bit of the present invention.

In a first example of cutters 41, 53, 53' of the hybrid bit 11, FIG. 4 shows a top view representation of an inline cutter set 60 having two side raked backup cutters 53, 53'. The primary cutting element 41 and the backup cutters 53, 53' being spaced from each other any desired distance d. FIG. 4 illustrates a linear representation of a rotational or helical swath or kerf or rotational path in which the inline cutter set 60 may be oriented upon a rotary drag bit. The inline cutter set 60 includes a primary cutting element 41 and two side raked backup cutters 53, 53'. The side raked backup cutter 53 rotationally follows the primary cutting element 41, and includes a side rake angle 55 which may be any desired side rake angle to the left of the rotational path, such as approximately 5° to approximately 75°. The side raked backup cutter 53' also includes a side rake angle to the right of the rotational path which is in the opposite direction to that of side raked backup cutter 53, as illustrated. While two side raked backup cutters 53, 53' are provided in the inline cutter set 60, additional side raked cutters may be provided. While wear flats 56, 57 may develop upon the primary cutting element 41 as it wears, by introducing the side rake angle 55 the side raked backup cutter 53, 53' cut parallel swaths or grooves or rotational paths with the apexes 58, 59, of side raked backup cutters 53 and 53', respectively, improving the ROP of the bit as well as directing the path of the cuttings generated by the bit. Also, as the wear flats 56, 57 grow upon the primary cutting element 41, the apexes 58, 59 of backup cutters 53, 53' are able to more effectively fracture and remove formation material on either side of primary cutting element 41. While the cutter set 60 is shown here having zero rake angle for primary cutting element 41 and side raked backup cutters 53, 53', the cutters 41, 53, 53' may also include any desired rake angle. While the side raked backup cutter 53, 53' is included with an inline cutter set 60, the side raked backup cutter 53, 53' may be utilized in any backup cutter set, a multiple backup cutter set, a cutter row, a multiple backup cutter row, a staggered cutter row, and a staggered cutter set in any desired manner. The rotational path in FIG. 4 is a linear representation of a rotational path or swath or kerf or helical path in which the inline cutter set 60 may be oriented upon hybrid bit 11.

Figure 4A:
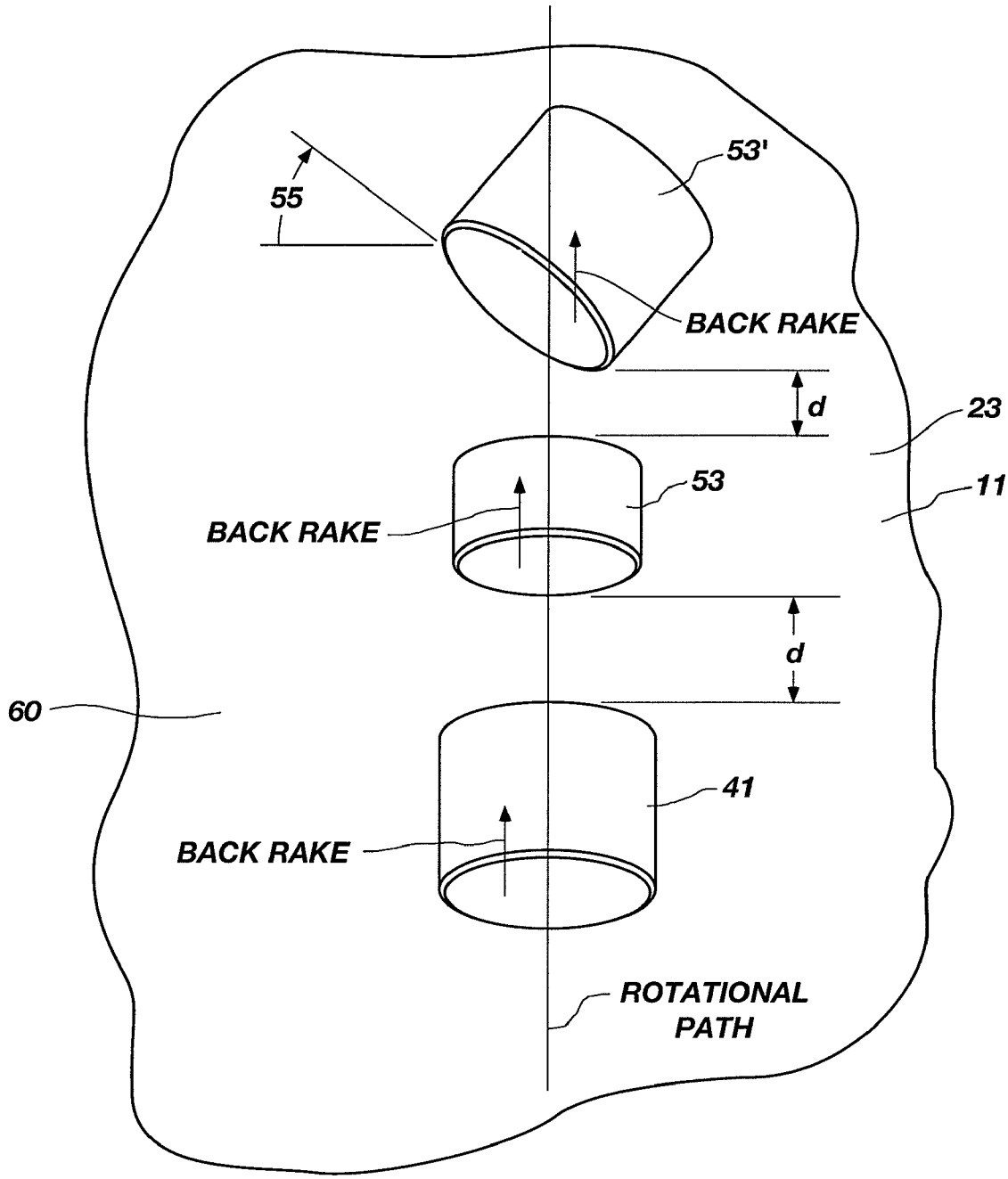

Illustrated in FIG. 4A, is a top view representation of an inline cutter set 60 having a primary cutting element 41, a backup cutter 53, and a backup cutter 53' all having the same centerline on the hybrid bit 11 illustrated as the rotational path for the cutter set 60, the primary cutting element 41 also has any desired back rake angle, the backup cutter 53 being smaller in diameter than primary cutting element 41 and having any desired back rake angle, and a backup cutter 53' being the same diameter as the primary cutting element 41, having any desired back rake angle, and having any desired side rake angle 55 to the left of the direction of the rotational path, such as approximately 10° to 60° or, in the alternative, approximately 5° to 75°, with respect to the rotational path of the cutter set 60. The primary cutting element 41 and the backup cutters 53, 53' are spaced from each other a distance d on fixed-blade cutter 23 while being located on the same rotational path. The rotational path in FIG. 4A is a linear representation of a rotational path or swath or kerf or helical path in which the inline cutter set 60 may be oriented upon rotary drag bit 11.

Figure 4B:
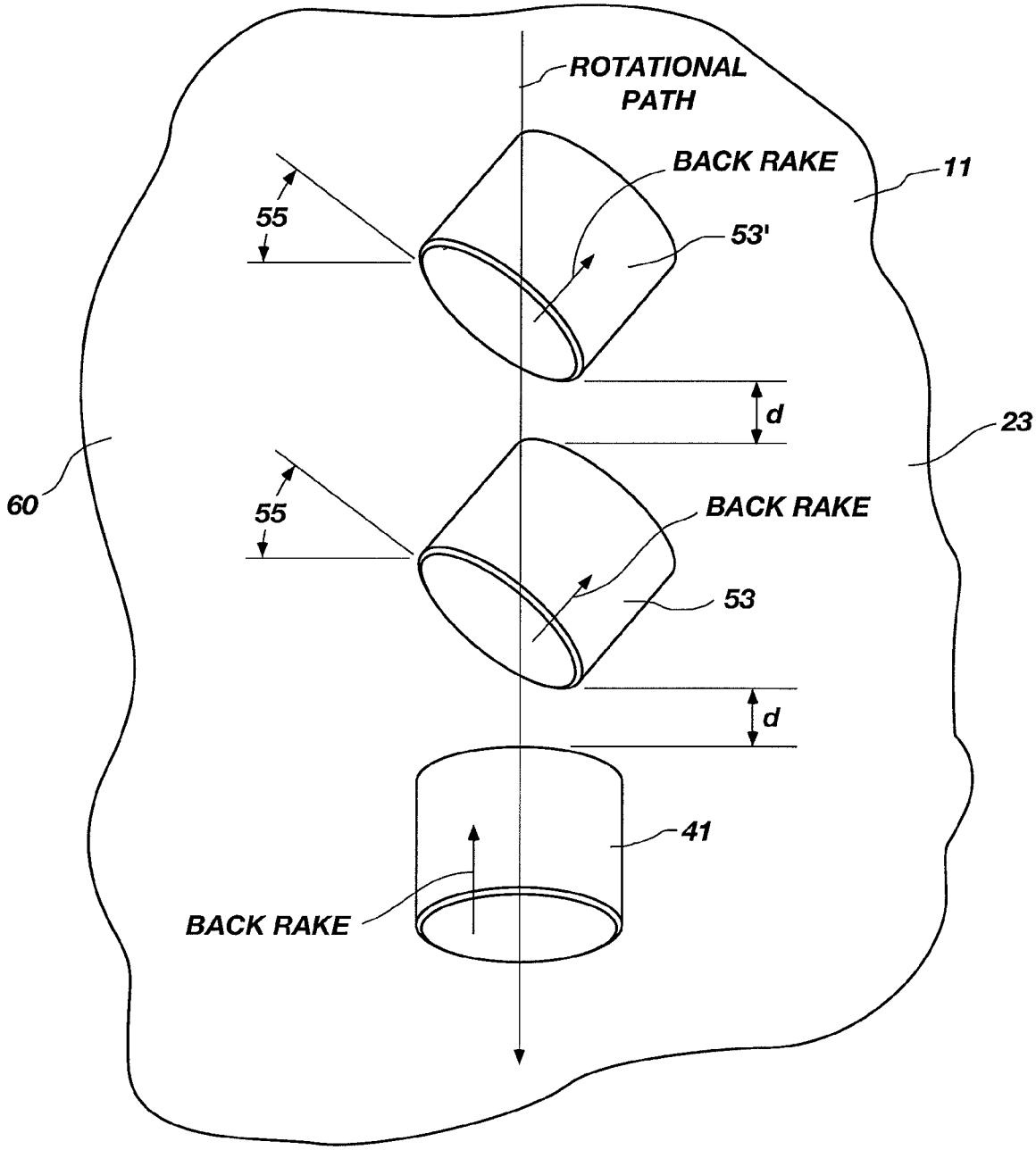

Illustrated in FIG. 4B, a top view representation of an inline cutter set 60 for the hybrid bit 11 including a primary cutting element 41 and two back raked and side raked backup cutters 53, 53', all having the same diameter, any desired back rake angle, and any desired side rake angle. The primary cutting element 41 and backup cutters 53, 53' spaced apart any desired distance d on the fixed-blade cutter 23. The backup cutters 53, 53' having any desired side rake angle 55. The primary cutting element 41 and side raked backup cutters, 53, 53' also having any desired back rake. FIG. 4B is a linear representation of a rotational or helical path in which the inline cutter set 60 may be oriented upon a hybrid bit 11. The back raked and side raked backup cutter 53 rotationally follows the back raked primary cutting element 41 while back raked and side raked backup cutter 53' follows backup cutter 53. The back raked and side raked backup cutter 53 includes a side rake angle 55, such as approximately 10° to 60° or, in the alternative, approximately 5° to 75°, to the left of the swath or kerf or the rotational path. While two back raked and side raked backup cutters 53, 53' are provided in the inline cutter set 60, additional back raked and side raked backup cutters may be provided.

Figure 4C:
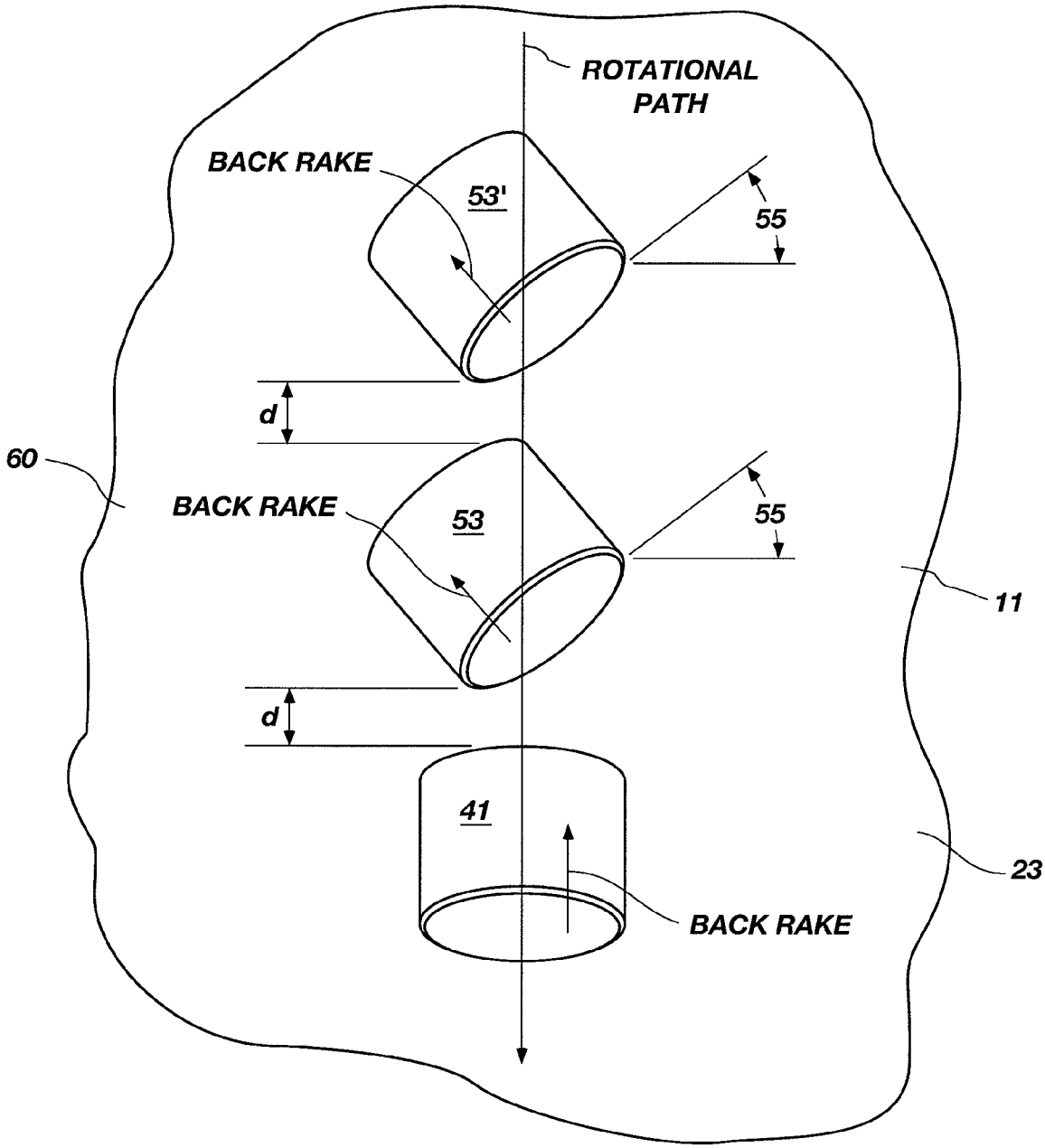

Illustrated in FIG. 4C, a top view representation of an inline cutter set 60 for the hybrid bit 11 including a primary cutting element 41 and two back raked and side raked backup cutters 53, 53', all having the same diameter, and desired back rake angle, and any desired side rake angle. The primary cutting element 41 and backup cutters 53, 53' spaced apart any desired distance d on the fixed-blade cutter 23. The backup cutters 53, 53' having any desired side rake angle 55 therefor. The primary cutting element 41 and side raked backup cutters 53, 53' also having any desired back rake. FIG. 4C is a linear representation of a rotational or helical path in which the inline cutter set 60 may be oriented upon a blade of a hybrid bit 11. The back raked and side raked backup cutter 53 rotationally follows the back raked primary cutting element 41 while back raked and side racked backup cutter 53' follows backup cutter 53. The back raked and side raked backup cutter 53 includes a side rake angle 55, such as approximately 10° to 60° or, in the alternative, approximately 5° to 75°, to the right of the swath or kerf or the rotational path. While two back raked and side raked backup cutters 53, 53' are provided in the inline cutter set 60, additional back raked and side raked backup cutters may be provided.

Figure 4D:
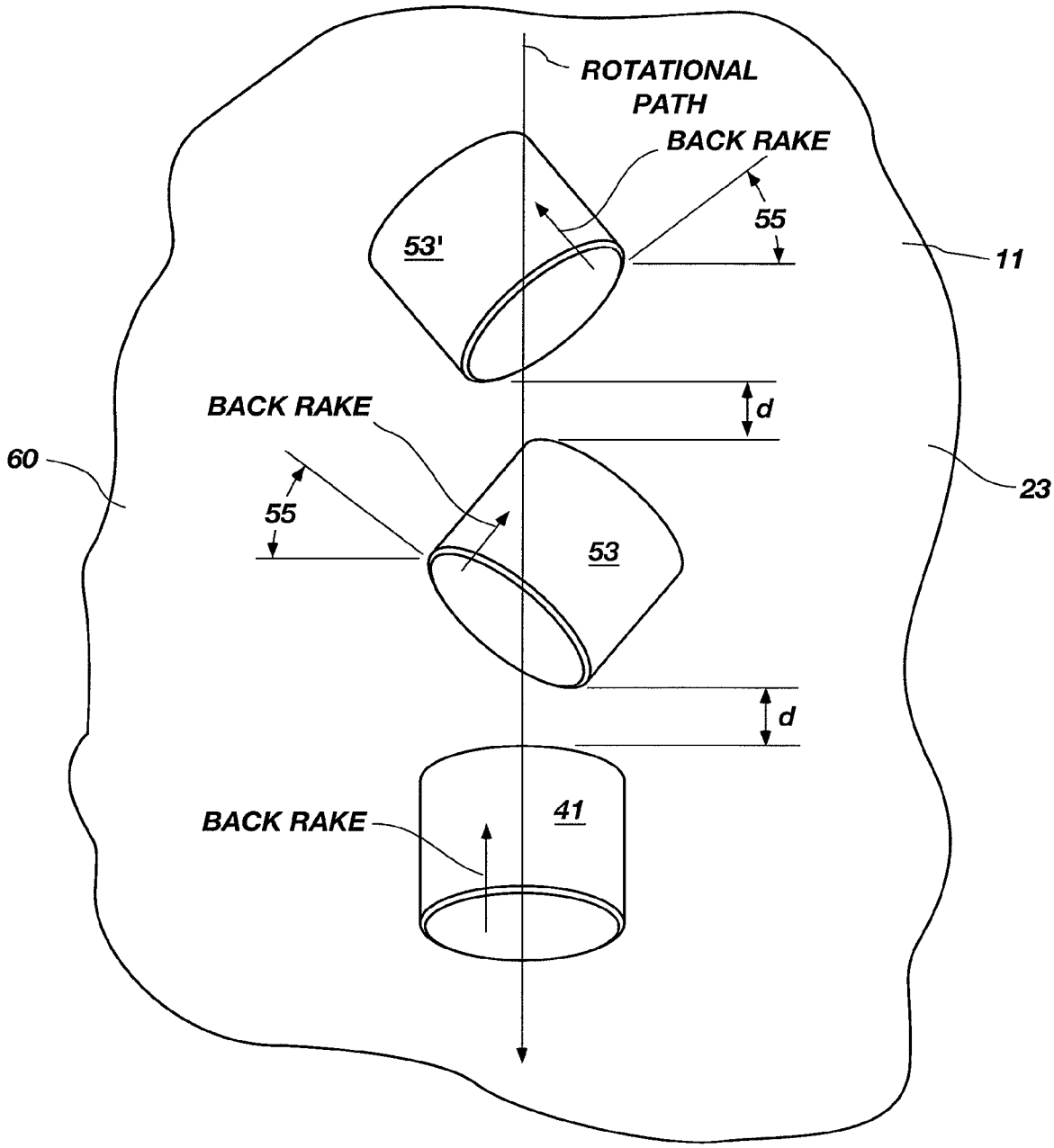

Illustrated in FIG. 4D, a top view representation of an inline cutter set 60 for the hybrid bit 11 including a back raked primary cutting element 41 and two back raked and side raked backup cutters 53, 53', all having the same diameter, any desired back rake angle, and any desired side rake angle. The primary cutting element 41 and backup cutters 53, 53' spaced apart any desired distance d on the fixed-blade cutter 23. FIG. 4D is a linear representation of a rotational or helical path in which the inline cutter set 60 may be oriented upon a fixed-blade cutter 23 of a hybrid bit 11. The back raked and side raked backup cutter 53 rotationally follows the back raked primary cutting element 41 while back raked and side raked backup cutter 53' follows backup cutter 53. The back raked and side raked backup cutters 53, 53' includes a side rake angle 55, such as approximately 10° to 60° or, in the alternative, approximately 5° to 75°, to the left and right respectively of the swath or kerf or the rotational path. While two back raked and side raked backup cutters 53, 53' are provided in the inline cutter set 60, additional back raked and side raked backup cutters may be provided.

Figure 4E:
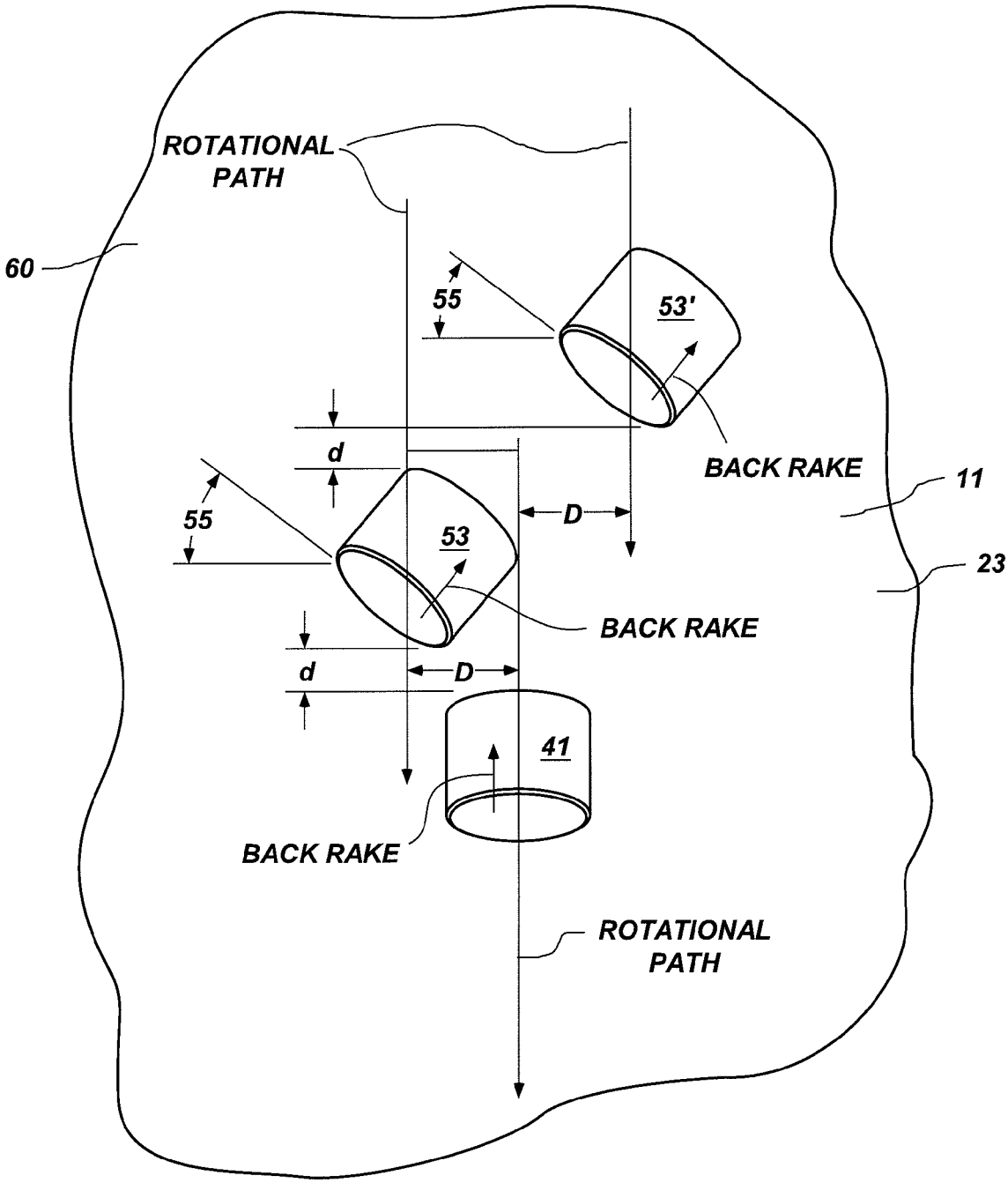

Illustrated in FIG. 4E, is a top view representation of an inline cutter set 60 for the hybrid bit 11 having a back raked cutting element 41 and two back raked and side raked backup cutters 53, 53', with side raked backup cutters 53, 53' having the same direction of the side rake angle being to the left of the rotational path of primary cutting element 41 and being offset a distance D, each about a swath or kerf or rotational path to the left and right of the rotational path of primary cutting element 41, respectively, while generally following in the swath or kerf or rotational path of the primary cutting element 41. Depending upon the distance D, the backup cutter 53 and 53' are spaced from the rotational path of the primary cutting element 41 will determine whether or not the backup cutter 53, 53' is a blade-leading cutter or blade-following cutter with respect to a corresponding cutting elements of a rolling cutter, which may be a leading rolling cutter or following rolling cutter on the hybrid bit 11. The primary cutting element 41 and the backup cutters 53, 53' are also spaced a distance d on fixed-blade cutter 23. Primary cutting element 41 and backup cutters 53, 53' having any desired back rake angle, while backup cutters 53, 53' additionally have any desired side rake angle of approximately 10° to 60° or, in the alternative, approximately 5° to 75°, on fixed-blade cutter 23 of hybrid bit 11. The inline cutter set 60 includes back raked primary cutting element 41 and back raked and side raked backup cutters 53, 53'. The back raked and side raked backup cutters 53, 53' include any desired side rake angles 55, such as approximately 10° to 60° or, in the alternative, approximately 5° to 75°, which are in the same direction to the left.

Figure 4F:
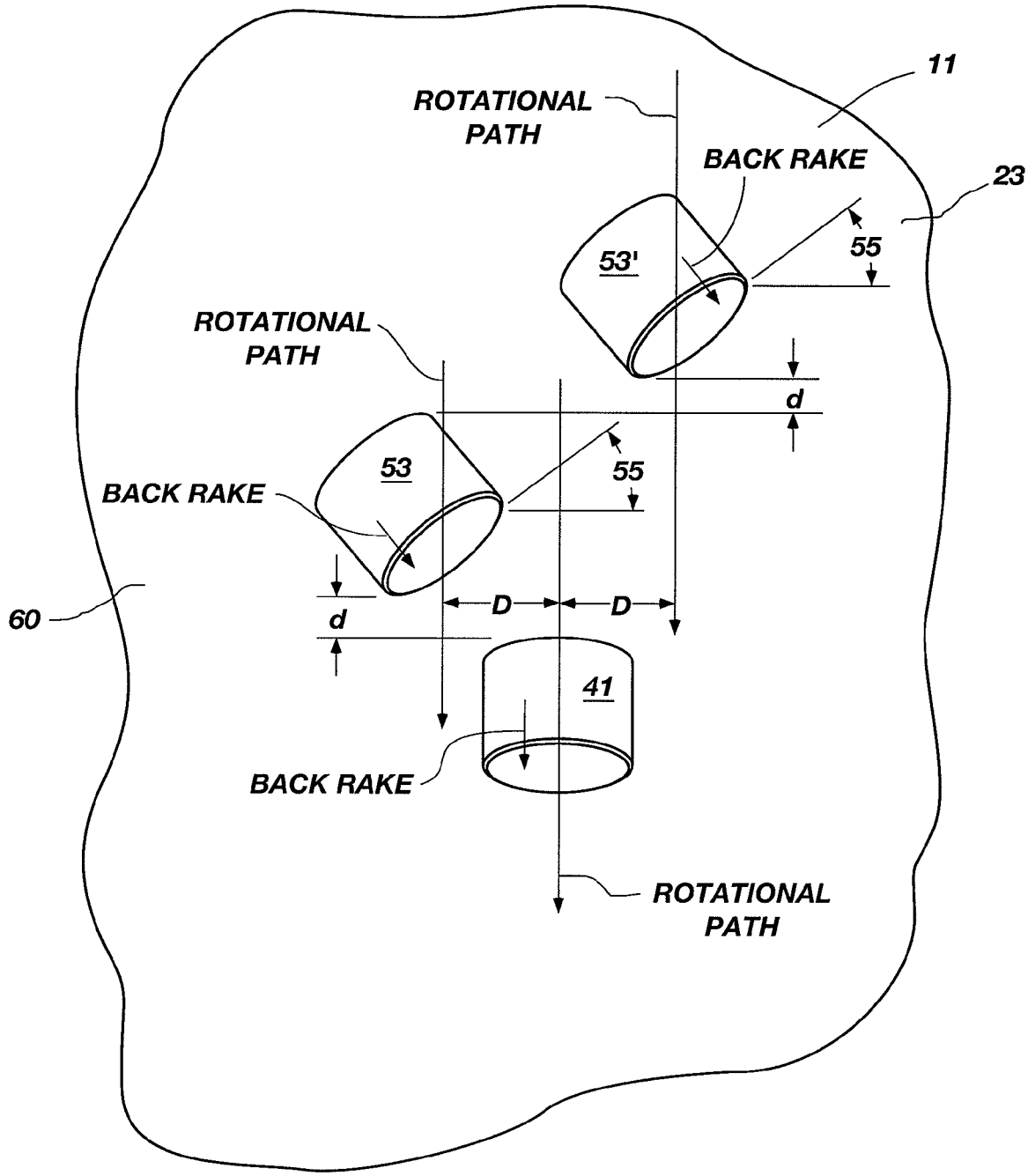

Illustrated in FIG. 4F, is a top view representation of an inline cutter set 60 for the hybrid bit 11 having a back raked cutting element 41 and two back raked and side raked backup cutters 53, 53', with side raked backup cutters 53, 53' having the same direction of the side rake angle being to the right of the rotational path of primary cutting element 41 and being offset a distance D, each about a swath or kerf or rotational path to the left and right of the rotational path of primary cutting element 41, respectively, while generally following in swath or kerf or rotational path of the primary cutting element 41. Depending upon the distance D, the backup cutter 53 and 53' are spaced from the rotational path of the primary cutting element 41 will determine whether or not the backup cutter 53, 53' is a blade-leading cutter or blade-following cutter with respect to a corresponding cutting element on a rolling cutter, which may be a leading rolling cutter or following rolling cutter on the hybrid bit 11. The primary cutting element 41 and the backup cutters 53, 53' are also spaced a distance d on fixed-blade cutter 23. Primary cutting element 41 and side raked backup cutters 53, 53' having any desired back rake angle, while backup cutters 53, 53' additionally have any desired side rake angle of approximately 10° to 60° or, in the alternative, approximately 5° to 75°, on fixed-blade cutter 23 of hybrid bit 11. The inline cutter set 60 includes back raked primary cutting element 41 and back raked and side raked backup cutters 53, 53'. The back raked and side raked backup cutters 53, 53' include any desired side rake angles 55, such as approximately 10° to 60° or, in the alternative, approximately 5° to 75°, which are in the same direction to the right of the rotational path.

Figure 4G:
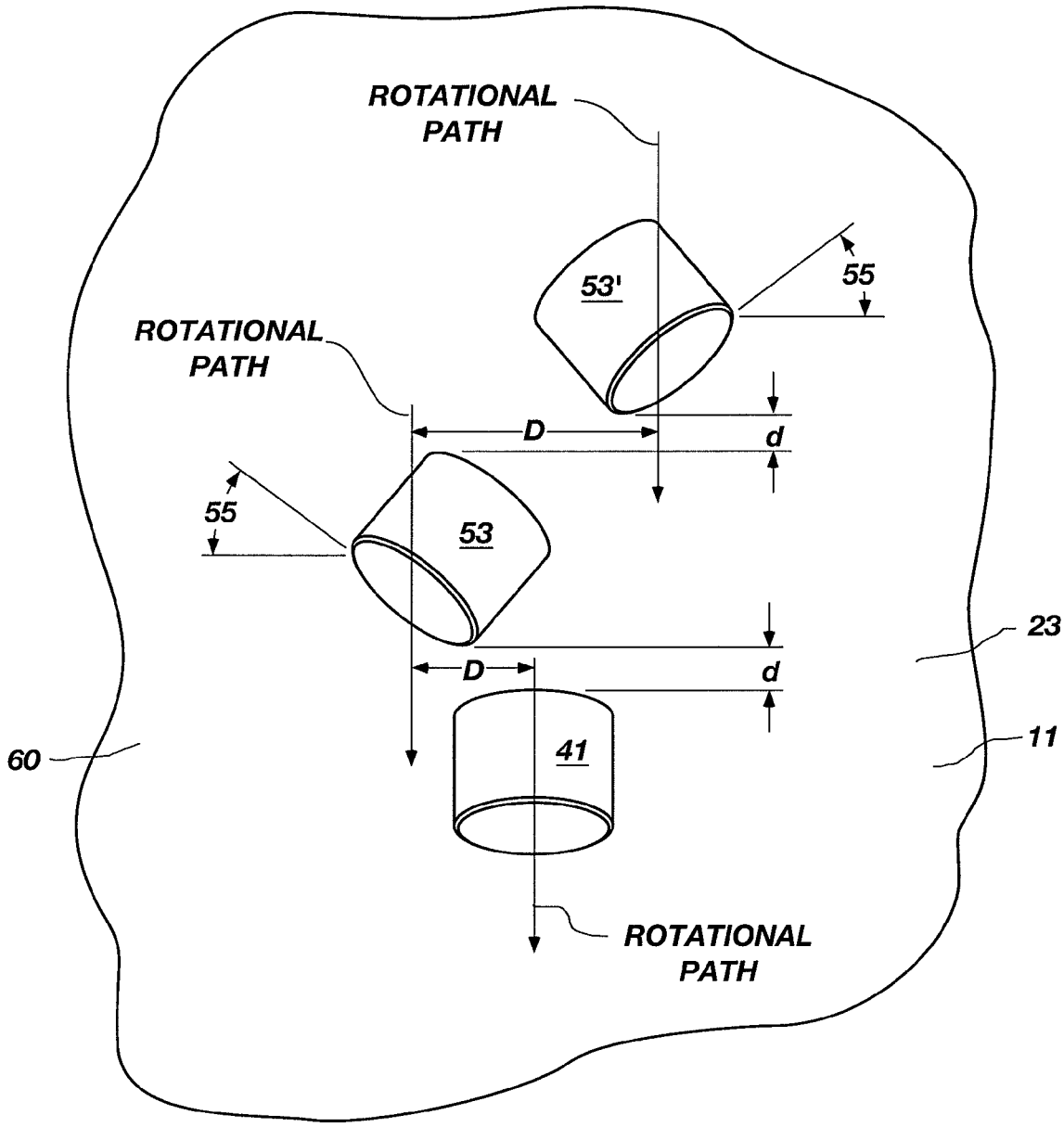

Illustrated in FIG. 4G, is a top view representation of an inline cutter set 60 for the hybrid bit 11 having a back raked cutting element 41 and two back raked and side raked backup cutters 53, 53', with side raked backup cutters 53, 53' having opposite side rake angles being to the left (53) and right (53') of the rotational path of primary cutting element 41 and being offset a distance D, each about a swath or kerf or rotational path to the left and right of the rotational path of primary cutting element 41, respectively, while generally following in swath or kerf or rotational path of the primary cutting element 41. Depending upon the distance D, the backup cutter 53 and 53' are spaced from the rotational path of the primary cutting element 41 will determine whether or not the backup cutter 53, 53' is a blade-leading cutter or blade-following cutter with respect to a cutting element of a corresponding rolling cutter, which may be a leading rolling cutter or following rolling cutter on the hybrid bit 11. The primary cutting element 41 and the backup cutters 53, 53' are also spaced a distance d on fixed-blade cutter 23. Primary cutting element 41 and side raked cutters 53, 53' having any desired back rake angle, while backup cutters 53, 53' additionally having any desired side rake angle of approximately 10° to 60° or, in the alternative, approximately 5° to 75°, on fixed-blade cutter 23 of hybrid bit 11. The inline cutter set 60 includes back raked primary cutting element 41 and back raked and side raked backup cutters 53, 53'. The back raked and side raked backup cutters 53, 53' include any desired side rake angles 55, such as approximately 10° to 60° or, in the alternative, approximately 5° to 75°, which are directed to the right and left.

While the configurations of primary cutting element 41 and the backup cutters 53, 53' are described with respect to fixed-blade cutter 23, such configurations may be used on fixed-blade cutters 25, 27 where desired.

While teachings of the present invention are described herein in relation to embodiments of hybrid drill bits, other types of earth-boring drilling tools such as, for example hole openers, rotary drill bits, raise bores, drag bits, cylindrical cutters, mining cutters, and other such structures known in the art, may embody the present invention and may be formed by methods that embody the present invention. Furthermore, while the present invention has been described herein with respect to certain preferred embodiments, those of ordinary skill in the art will recognize and appreciate that it is not so limited. Rather, many additions, deletions and modifications to the described and illustrated embodiments may be made without departing from the scope of the invention as hereinafter claimed. In addition, features from one embodiment may be combined with features of another embodiment while still being encompassed within the scope of the invention as contemplated by the inventors.

What is claimed is:

1. A hybrid drill bit comprising:

a bit body with an axis;

at least one blade extending longitudinally and radially outward from the bit body;

at least one rolling cutter assembly mounted on the bit body;

at least one primary cutter including a cutting surface protruding at least partially from the at least one blade and located to traverse a cutting path upon rotation of the bit body about the axis; and a plurality of cutters, each cutter of the plurality of cutters positioned to substantially follow the at least one primary cutter along the cutting path upon rotation of the bit body about its axis, and at least one cutter of the plurality of cutters having a non-zero side rake angle, wherein each cutter having a non-zero side rake angle is oriented to deflect material in a common direction with respect to the cutting path.

2. The hybrid drill bit of claim 1, wherein the non-zero side rake angle of at least one cutter of the plurality of cutters comprises a side rake angle between about thirty (30) degrees and about seventy-five (75) degrees.

3. The hybrid drill bit of claim 1, wherein at least one cutter of the plurality of cutters is offset from the rotational path of the primary cutter.

4. The hybrid drill bit of claim 1, wherein the hybrid drill bit comprises a cutter-opposite hybrid drill bit wherein a cutter on a rolling cutter is located substantially opposite a primary cutter on a fixed-blade cutter of the hybrid bit.

5. The hybrid drill bit of claim 1, wherein the hybrid drill bit comprises a rolling cutter-leading hybrid drill bit wherein a cutter of a rolling cutter leads a cutter on a fixed-blade cutter.

6. The hybrid drill bit of claim 1, wherein the hybrid drill bit comprises a blade-leading hybrid drill bit wherein a cutter on a fixed-blade cutter leads a cutter on a rolling cutter of the hybrid bit.

7. The hybrid drill bit of claim 1, wherein the at least one blade is a primary blade comprising a blade surface and a leading face, a primary cutter row comprising the at least one primary cutter aligned substantially toward the leading face and radially extending outward from the axis, and the at least one primary cutter coupled to the blade surface proximate the leading face.

8. The hybrid drill bit of claim 1, wherein the plurality of cutters comprise backup cutters in rows, each backup cutter row having at least one cutter having a non-zero side rake angle.

9. The hybrid drill bit of claim 1, wherein each cutter having a non-zero side rake angle has substantially the same side rake angle.

10. The hybrid drill bit of claim 9, wherein at least one cutter of the plurality of cutters is a backup cutter and wherein the backup cutter is smaller than the at least one primary cutter.

11. The hybrid drill bit of claim 1, wherein the at least one cutter of the plurality of cutters is the same size as the at least cutter of the one primary cutter.

12. The hybrid drill bit of claim 11, wherein a second cutter of the plurality of cutters is underexposed with respect to a first cutter of the plurality of cutters.

13. The hybrid drill bit of claim 11, wherein a first cutter of the plurality of cutters and a second cutter of the plurality of cutters are each underexposed with respect to the at least one primary cutter.

14. The hybrid drill bit of claim 1, wherein at least one cutter of the plurality of cutters rotationally follows the at least one primary cutter within the cutting path.

15. The hybrid drill bit of claim 1, wherein a first cutter and a second cutter of the plurality of cutters each rotationally follow the at least one primary cutter within the cutting path.

16. The hybrid drill bit of claim 1, wherein one cutter of the plurality of cutters rotationally follows the at least one primary cutter inline with the cutting path.

17. The hybrid drill bit of claim 1, wherein at least one cutter of the plurality of cutters is underexposed with respect to the at least one primary cutter.

18. The hybrid drill bit of claim 1, wherein a first cutter and a second cutter of the plurality of cutters are underexposed with respect to the at least one primary cutter.

19. The hybrid drill bit of claim 1, wherein a first cutter of the plurality of cutters is a backup cutter and a second cutter of the plurality of cutters is utilized in a multiple backup cutter row, a cutter of the multiple backup cutter row including another backup cutter to the at least one primary cutter.

20. The hybrid drill bit of claim 1, wherein the at least one blade includes one or more additional cutters in a row, each row comprising at least one additional cutter including a cutting surface protruding at least partially from the at least one blade and positioned so as to substantially follow the at least one primary cutter along the cutting path and configured to selectively engage the formation upon movement along the cutting path.

21. The hybrid drill bit of claim 1, wherein the at least one primary cutter and the at least one cutter of the plurality of cutters are polycrystalline diamond compact (PDC) cutters.

22. The hybrid drill bit of claim 1, further comprising:

a bearing pin; and at least one rolling cutter assembly rotatably mounted on the bearing pin, the at least one rolling cutter assembly comprising:

a rolling cutter of steel material.

23. The hybrid drill bit of claim 22, further comprising at least one cutting element disposed on the at least one rolling cutter assembly.

24. The hybrid drill bit of claim 22, further comprising at least a portion of a cutting tooth structure disposed on the at least one rolling cutter assembly.

25. The hybrid drill bit of claim 1, wherein a first cutter of the plurality of cutters has a side rake angle between about 30 degrees and about 90 degrees.

26. The hybrid drill bit of claim 25, wherein a second cutter of the plurality of cutters has a side rake angle between about 30 degrees and about 90 degrees.

27. The hybrid drill bit of claim 1, wherein a first cutter of the plurality of cutters has a side rake angle between about negative 30 degrees and about negative 90 degrees.

28. The hybrid drill bit of claim 27, wherein a second cutter of the plurality of cutters has a side rake angle between about negative 30 degrees and about negative 90 degrees.

29. The hybrid drill bit of claim 1, wherein a first cutter of the plurality of cutters has a side rake angle between about 30 degrees and about 75 degrees in a first direction and a second cutter of the plurality of cutters has a side rake angle between about 30 degrees and about 75 degrees in a direction the same as that of the first cutter.

30. The hybrid drill bit of claim 1, wherein a first cutter of the plurality of cutters has a side rake angle between about 30 degrees and about 90 degrees and a second cutter of the plurality of cutters has a side rake angle between about 30 degrees and about 90 degrees in a direction the same as that of the first cutter.

31. The hybrid drill bit of claim 1, wherein a first cutter of the plurality of cutters and a second cutter of the plurality of cutters are offset a distance from the cutting path of the primary cutter.

32. The hybrid drill bit of claim 1, wherein a first cutter of the plurality of cutters and a second cutter of the plurality of cutters are offset a distance from the cutting path of the primary cutter in different directions.

33. The hybrid drill bit of claim 1, wherein a first cutter of the plurality of cutters and a second cutter of the plurality of cutters are offset a distance from the cutting path of the primary cutter in the same direction.

34. The hybrid drill bit of claim 1, wherein the at least one cutter of the plurality of cutters has an angle of back rake.

35. The hybrid drill bit of claim 1, wherein at least one cutter of the plurality of cutters has a positive angle of back rake.

36. The hybrid drill hit of claim 1 wherein at least one cutter of the plurality of cutters has a negative angle of back rake.

37. The hybrid drill bit of claim 1, wherein the primary cutter has an angle of back rake.

38. The hybrid drill bit of claim 1, wherein the primary cutter has a negative angle of back rake.

39. The hybrid drill bit of claim 1, wherein the primary cutter has a positive angle of back rake.

40. The hybrid drill bit of claim 1, wherein the at least one primary cutter and at least one of the cutter of the plurality of cutters have an angle of back rake.

41. A hybrid drill hit comprising:

a bit body having an axis;

at least one blade extending longitudinally and radially outward from the bit body;

at least one rolling cutter assembly mounted on the bit body;

at least one primary cutter, the primary cutter including a cutting surface protruding at least partially from the at least one blade and located to traverse a cutting path upon rotation of the bit body about the axis; and at least one backup cutter set comprising a plurality of trailing cutters, each trailing cutter including a cutting surface protruding at least partially from the at least one blade, the plurality of trailing cutters having a plurality of trailing cutters at a non-zero side rake angle, each oriented in a common direction with respect to the cutting path for control of deflection of formation debris towards an open space between the at least one blade and the at least one rolling cutter assembly, the side rake angle between about thirty (30) degrees and about ninety (90) degrees.

* * * * *

UNITED STATES PATENT AND TRADEMARK OFFICE

CERTIFICATE OF CORRECTION

PATENT NO. : 8,047,307 B2
APPLICATION NO. : 12/340299
DATED : November 1, 2011
INVENTOR(S) : Rudolf Carl Pessier et al.

It is certified that error appears in the above-identified patent and that said Letters Patent is hereby corrected as shown below:

On the title page:

In ITEM (56) References Cited

OTHER PUBLICATIONS

Page 3, 1st column, line 12 — change "Diamon" to --Diamond--

In the specification:

| | | |
|---|---|---|
| COLUMN 1, | LINE 12, | change "7,841,426" to --7,841,426,-- |
| COLUMN 10, | LINE 20, | change "cutters," to --cutters-- |
| COLUMN 10, | LINE 48, | change "racked" to --raked-- |
| COLUMN 11, | LINE 4, | change "right respectively" to --right, respectively,-- |

In the claims:

| | | | |
|---|---|---|---|
| CLAIM 8, | COLUMN 13, | LINE 30, | change "comprise" to --comprises-- |
| CLAIM 11, | COLUMN 13, | LINE 40, | change "wherein the" to --wherein-- |
| CLAIM 11, | COLUMN 13, | LINE 42, | change "cutter of the one primary" to --one primary-- |
| CLAIM 34, | COLUMN 14, | LINE 63, | change "wherein the" to --wherein-- |
| CLAIM 36, | COLUMN 15, | LINE 1, | change "hit of claim **1**" to --bit of claim **1**,-- |
| CLAIM 40, | COLUMN 15, | LINE 10, | change "cutter" to --cutters-- (2nd occurrence) |

Signed and Sealed this
Eighth Day of September, 2015

Michelle K. Lee

Michelle K. Lee
*Director of the United States Patent and Trademark Office*